US007650850B2

(12) United States Patent
Iwasaki et al.

(10) Patent No.: US 7,650,850 B2
(45) Date of Patent: Jan. 26, 2010

(54) LIQUID APPLYING APPARATUS AND INK JET PRINTING APPARATUS

(75) Inventors: Osamu Iwasaki, Tokyo (JP); Naoji Otsuka, Yokohama (JP); Yoshinori Nakagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 216 days.

(21) Appl. No.: 11/052,025

(22) Filed: Feb. 8, 2005

(65) Prior Publication Data

US 2005/0178323 A1 Aug. 18, 2005

(30) Foreign Application Priority Data

Feb. 12, 2004 (JP) ..... 2004-035804

(51) Int. Cl.
*B05C 5/02* (2006.01)
*B05C 1/08* (2006.01)

(52) U.S. Cl. ..... 118/300; 118/126; 118/261; 101/424.2; 347/101; 347/103

(58) Field of Classification Search ..... 118/257, 118/255, 216, 217, 106, 126, 261, 72, 73, 118/300; 347/103, 101; 399/325, 296; 101/424.2
See application file for complete search history.

(56) References Cited

U.S. PATENT DOCUMENTS

| | | | | |
|---|---|---|---|---|
| 5,207,159 | A | 5/1993 | DeMoore et al. | 101/350 |
| 5,335,596 | A | 8/1994 | DeMoore et al. | |
| 5,960,713 | A | 10/1999 | DeMoore et al. | |
| 6,183,079 | B1 | 2/2001 | Meade et al. | |
| 6,576,059 | B2 * | 6/2003 | Burgard | 118/683 |
| 6,585,364 | B2 * | 7/2003 | Kasperchik et al. | 347/98 |
| 7,105,203 | B1 | 9/2006 | Masuda et al. | 427/286 |

FOREIGN PATENT DOCUMENTS

| | | |
|---|---|---|
| CN | 1079689 A | 12/1993 |
| CN | 1263798 A | 8/2000 |
| JP | 8-58069 | 3/1996 |
| JP | 8-72227 | 3/1996 |
| JP | 2001-70858 | 3/2001 |
| JP | 2002-96452 | 4/2002 |
| JP | 2002-517341 | 6/2002 |

* cited by examiner

*Primary Examiner*—Laura Edwards
(74) *Attorney, Agent, or Firm*—Fitzpatrick, Cella, Harper & Scinto

(57) ABSTRACT

The present invention provides a liquid applying apparatus and an ink jet printing apparatus which, when supplying a liquid to and/or collecting the liquid from a liquid holding member holding an application liquid in a space formed by a roller being abutted, can suppress the leakage of the liquid from the liquid holding member. A pump is provided in a collecting path between a storage tank and a liquid collecting port formed in the liquid holding member that is liquid-tight. The pump is driven to circulate the application liquid between the storage tank and the liquid holding member.

16 Claims, 28 Drawing Sheets

LIQUID APPLYING APPARATUS AND INK JET PRINTING APPARATUS

BACKGROUND OF THE INVENTION

1. Field of the Invention

The present invention relates to a liquid applying apparatus and an ink jet printing apparatus, and specifically, to a liquid applying apparatus that applies a liquid to a medium for a predetermined purpose, for example, for starting the coagulation of pigments earlier when printing is carried out using inks composed of the pigments as color materials. Likewise, the present invention relates to an ink jet printing apparatus comprising a mechanism that applies the liquid to a print medium used for ink jet printing, for a predetermined purpose, for example, for starting the coagulation of pigments earlier when printing is carried out using inks composed of the pigments as color materials.

2. Description of the Related Art

A spin coater, a roll coater, a bar coater, and a die coater are known as systems for applying a liquid or an aqueous material to various media. These applying systems are premised on continuous applying on relatively long applying media. Thus, for example, if applying media having a relatively small size and intermittently conveyed are to be applied the liquid to, paint beads may be disturbed at a position at which applying is started or ended. In this case, the coats obtained may be nonuniform among the applying media.

A known configuration that can solve this problem is described in Japanese Patent Application Laid-open No. 2001-070858. On the basis of the die coater system, this configuration uses a rotating rod bar and ejects a paint to the rod bar through an ejection slit to form a coat on the rod bar. The coat formed is contacted with and transferred to a applying medium as the rod bar rotates. In this case, when the coat formed on the rod bar is not transferred or applied to the applying medium, the paint is returned to a head by the rotation of the rod bar. The paint is then collected via a collecting slit. In other words, the rod bar continues to rotate even during non-applying, while the paint is being formed into a coat on the rod bar. This enables a uniform coat to be obtained even if applying media are intermittently supplied and applied the paint.

Even in the field of ink jet printing apparatuses, those using a liquid applying mechanism are known. Japanese Patent Application Laid-open No. 2002-517341 describes an apparatus which uses a doctor blade contacting with a roller and in which the application liquid is collected between the blade and the roller so that the application liquid is applied to the roller as the roller rotates. As the roller rotates, the application liquid applied to the roller is transferred and applied to a support conveyed between this roller and another roller. Japanese Patent Application Laid-open No. 08-072227 (1996) similarly discloses a mechanism in an ink jet printing apparatus which applies a treatment liquid before printing which liquid insolubilizes dyes. In Embodiment 1 of this document, the treatment liquid in a replenishing tank is pumped by being attached to the rotating roller. At the same time, the treatment liquid pumped is applied to print paper.

With the configurations described in the above patent documents, a application liquid is applied or supplied to the surface of the rod bar or roller. However, the part of the rod bar or roller to which the application liquid is applied or supplied is open to or in communication with the air. Thus, disadvantageously, the application liquid may be evaporated or for example, the application liquid may leak when the posture of the apparatus is changed.

In particular, with an ink jet printing apparatus such as a printer, in view of, for example, the leakage of the liquid caused by a change in the posture of the apparatus, it is difficult to apply the applying mechanism described in the above documents to the apparatus if its size has been reduced.

In contrast, Japanese Patent Application Laid-open No. 08-058069 (1996) discloses a configuration that seals a part that applies or supplies inks, that is, application liquids, to a roller. The applying mechanism described in this document operates in a gravure printing apparatus to apply inks to a roller (applying roller) having the surface of which is formed with a pattern of a printing plate. This mechanism uses an ink chamber having two doctor blades arranged at two vertical positions along a peripheral surface of the roller and extending in a longitudinal direction of the roller and elastic members provided at the opposite sides of the two doctor blades. The chamber is contacted with the peripheral surface of the roller to form a liquid chamber between the ink chamber and the roller. Then, the roller is rotated to apply or supply the application liquid from the liquid chamber to the roller.

In Japanese Patent Application Laid-open No. 08-058069 (1996), a pump is provided between an ink tank in which ink is stored and the above-mentioned liquid chamber. The pump supplies the ink from the ink tank to the liquid chamber by feeding the ink from the ink tank to the liquid chamber under pressure. Further, the pump feeds the ink from the liquid chamber to an accommodating tank that receives the ink. In this case, it is necessary to prevent a leakage of the liquid (inks) supplied by the pump from the liquid chamber. However, in Japanese Patent Application Laid-open No. 08-058069 (1996), because of a construction of a pressurizing supply which supply the liquid for the liquid chamber by pressurizing the pressure in the liquid chamber increase and it is easy to occur the leakage of the liquid.

SUMMARY OF THE INVENTION

The present invention can solve the above-mentioned problems. The present invention can provide a liquid applying apparatus and an ink jet printing apparatus which, when supplying a liquid to and/or collecting the liquid from a liquid holding member holding the liquid in a space formed between rollers, can suppress the leakage of the liquid from the liquid holding member.

In the first aspect of the present invention, there is provided a liquid applying apparatus comprising:

a liquid applying means, which is provided with an applying member having a applying surface that applies a liquid to a medium and a holding member that abuts against the applying surface of the applying member to form a liquid holding space to hold the liquid, for applying the liquid held in the liquid holding space to the medium through the applying surface by rotating the applying surface;

a storage means for storing the liquid;

a supply path that supplies the liquid to the holding member from the storage means;

a collecting path that collects the liquid from the holding member to the storage means; and a liquid moving means located in the collecting path to generate a flow of the liquid in a channel including the supply path, the liquid holding space, and the collecting path.

In the second aspect of the present invention, there is provided an ink jet printing apparatus comprising:

a liquid applying means, which is provided with a applying member having an applying surface that applies a liquid to a medium and a holding member that abuts against the applying surface of the applying member to form a liquid holding space to hold the liquid, for applying the liquid held in the liquid holding space to the medium by through the applying surface rotating the applying surface;

an image forming means for forming an image by ejecting inks from a print head in which a plurality of nozzles are arranged on the medium to which the liquid has been applied by the liquid applying means;

a storage means for storing the liquid;

a supply path that supplies the liquid to the holding member from the storage means;

a collecting path that collects the liquid from the holding member to the storage means; and a liquid moving means located in the collecting path to generate a flow of the liquid in a channel including the supply path, the liquid holding space, and the collecting path.

In the third aspect of the present invention, there is provided a method for collecting a liquid in a liquid applying apparatus comprising:

a preparing step of preparing the liquid applying apparatus comprising a applying member having an applying surface that applies a liquid to a medium and a holding member that abuts against the applying surface of the applying member to form a liquid holding space to hold the liquid, the apparatus applying the liquid held in the liquid holding space to the medium through the applying surface by rotating the applying surface;

a collecting step of collecting the liquid from the holding member via a collecting port formed in the holding member to storage means for storing the liquid, and wherein the collecting step collects the liquid into the storage means by relatively reducing a pressure at the collecting port below a pressure at a supply port formed in the holding member to supply the liquid to the holding member, to generate a flow of the liquid moving from the supply path to the collecting path via the liquid holding space.

In the fourth aspect of the present invention, there is provided a printing apparatus comprising:

a liquid applying means, which is provided with a applying member having an applying surface that applies a liquid to a medium and a holding member that abuts against the applying surface of the applying member to form a liquid holding space to hold the liquid, for applying the liquid held in the liquid holding space to the medium through the applying surface by rotating the applying surface;

an image forming means for forming an image on the medium to which the liquid has been applied by the liquid applying means;

a storage means for storing the liquid;

a supply path that supplies the liquid to the holding member from the storage means;

a collecting path that collects the liquid from the holding member to the storage means; and a liquid moving means located in the collecting path to generate a flow of the liquid in a channel including the supply path, the liquid holding space, and the collecting path.

The term "liquid moving means" used in the present invention refers to a pump.

According to the present invention, the liquid moving means (pump) is provided between the collecting port of the liquid holding means and the storage means. Accordingly, when the pump is driven to supply a liquid to and/or collect the liquid from the liquid holding means, it is possible to suppress the possible leakage of the liquid.

The above and other objects, effects, features and advantages of the present invention will become more apparent from the following description of embodiments thereof taken in conjunction with the accompanying drawings

DETAILED DESCRIPTION OF PREFERRED EMBODIMENTS

Preferred embodiments of the present invention will be described below in detail with reference to the accompanying drawings.

Figure 1:
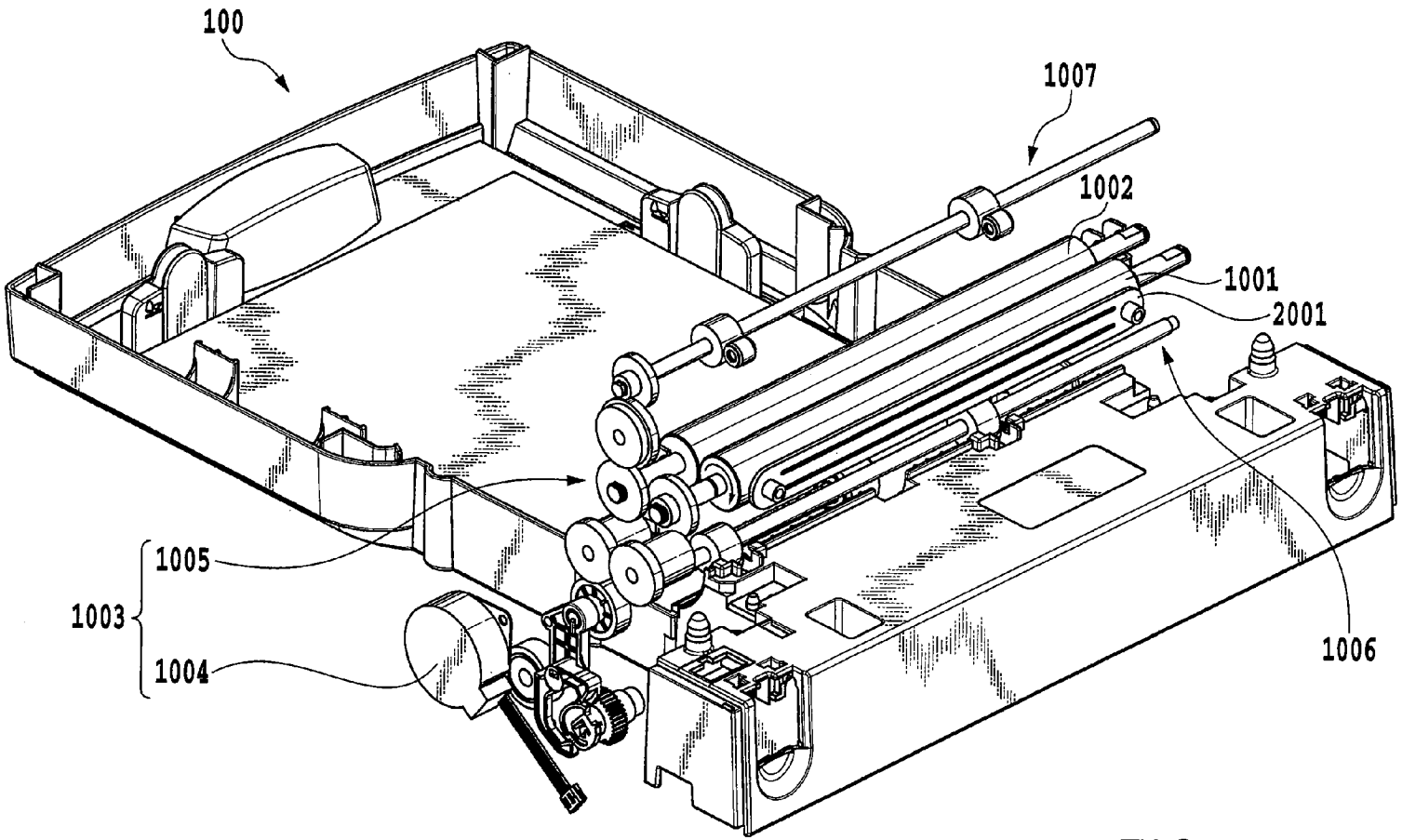
FIG. 1 is a perspective view generally showing the configuration of an embodiment according to a liquid applying apparatus of the present invention.

FIG. 1 is a perspective view generally showing the configuration of an embodiment according to a liquid applying apparatus 100 of the present invention. The liquid applying apparatus shown in FIG. 1 roughly has liquid applying means for applying a predetermined application liquid to a medium to which a liquid is to be applied (this medium will be referred to as a applying medium in the description below) and liquid supplying means for supplying a application liquid to the liquid applying means.

The liquid applying means has a cylindrical applying roller 1001, a cylindrical counter roller (medium supporting member) placed opposite the applying roller 1001 and a roller driving mechanism 1003 that drives the applying roller 1001. The roller driving mechanism 1003 comprises a roller driving motor 1004 and a transmission mechanism 1005 which transmits the driving force of the roller driving motor 1004 to the applying roller 1001 and which has a gear train and the like.

The liquid supplying means has, for example, a liquid holding member 2001 that holds the application liquid between the liquid holding member 2001 and a peripheral surface of the applying roller 1001, and a liquid channel 3000 (not shown in FIG. 1) described later and through which the liquid is supplied to the liquid holding member 2001. The applying roller 1001 and the counter roller 1002 are rotatively movably supported by respective shafts which are parallel to each other and each of which has opposite ends rotatively movably attached to a frame (not shown). Further, the liquid holding member 2001 extends almost all along the applying roller 1001 in a longitudinal direction. The liquid holding member 2001 is movably attached to the frame via a mechanism that enables the liquid holding member 2001 to contact with and separate from the peripheral surface of the applying roller 1001.

The liquid applying apparatus according to the present embodiment further comprises a applying medium supplying mechanism 1006 which consists of a pickup roller or the like to convey a applying medium to a nip portion between the applying roller 1001 and the counter roller 1002. Further, in a conveying path for applying media, a sheet discharging mechanism 1007 consisting of a sheet discharging roller or the like is provided downstream of the applying roller 1001 and the counter roller 1002 to convey a applying medium on which the application liquid has been applied, to a sheet discharging section (not shown) Like the applying roller and the like, the sheet supplying mechanism and the sheet discharging mechanism are operated under the driving force of the driving motor 1004 transmitted via the transmission mechanism 1005.

The application liquid used in the present embodiment is intended to facilitate the coagulation of pigments when printing has been carried out using inks including the pigments as color materials.

An example of the components of the application liquid is shown below.

Tetrahydrate of calcium nitrate: 10%
Glycerin: 42%
Surface active agent: 1%
Water: remaining amount The application liquid has a viscosity of 5 to 6 cp (centipoise) at 25° C.

In applications of the present invention, of course, the application liquid is not limited to the one described above. For example, a liquid including a component which insolubilizes or coagulate a dye may be used as another application liquid.

If water is used as a liquid to be applied, the slidability of the abutting portion between the applying roller and the liquid holding member according to the present invention is improved by containing a component that reduces surface tension in the liquid. In the above example of the components of the liquid to be applied, the glycerin and the surface active agent are components that reduce the surface tension.

Now, a detailed description will be given of the elements of the sections of the applying apparatus described above in brief.

Figure 2:
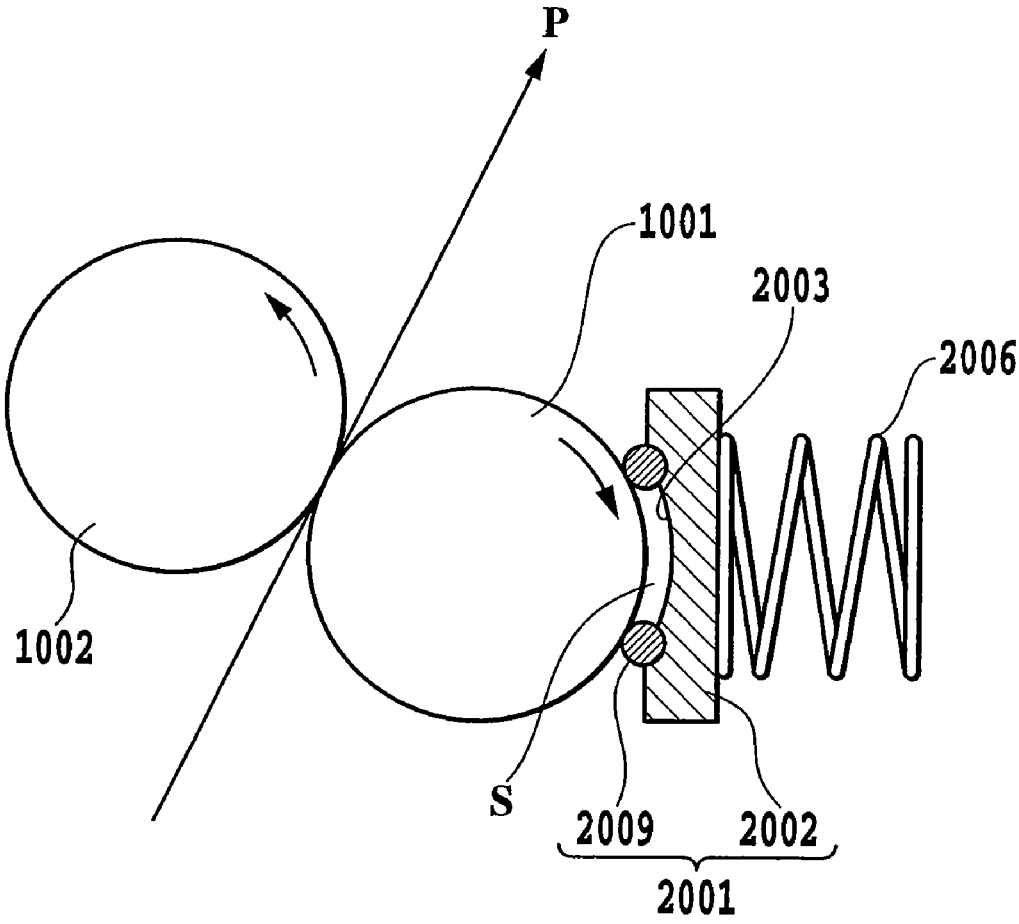
FIG. 2 is a vertical side view showing an example of the arrangement of an applying roller, a counter roller, and a liquid holding member which are shown in FIG. 1.

FIG. 2 is a vertical sectional view illustrating an example of the arrangement of the applying roller 1001, the counter roller 1002, and the liquid holding member 2001.

The counter roller 1002 is biased by biasing means (not shown) toward the peripheral surface of the applying roller 1001. By rotating the applying roller 1001 clockwise in the figure, it is possible to sandwich a applying medium P on which the application liquid is to be applied, between the rollers, while conveying the applying medium P in the direction of an arrow in the figure.

Further, when urged and abutted against the peripheral surface of the applying roller 1001 under the biasing force of a spring member (pressing means) 2006, the liquid holding member 2001 forms an elongate liquid holding space S extending all over an area applied the liquid by the applying roller 1001. The application liquid from a liquid channel 3000, described later, is supplied to the interior of the liquid holding space S via the liquid holding member 2001. In this case, since the liquid holding member 2001 is configured as described below, the application liquid can be prevented from inadvertently leaking from the liquid holding space S to the exterior while the applying roller 1001 is stopped.

FIGS. 3 to 8 show the configuration of the liquid holding member 2001.

Figure 3:
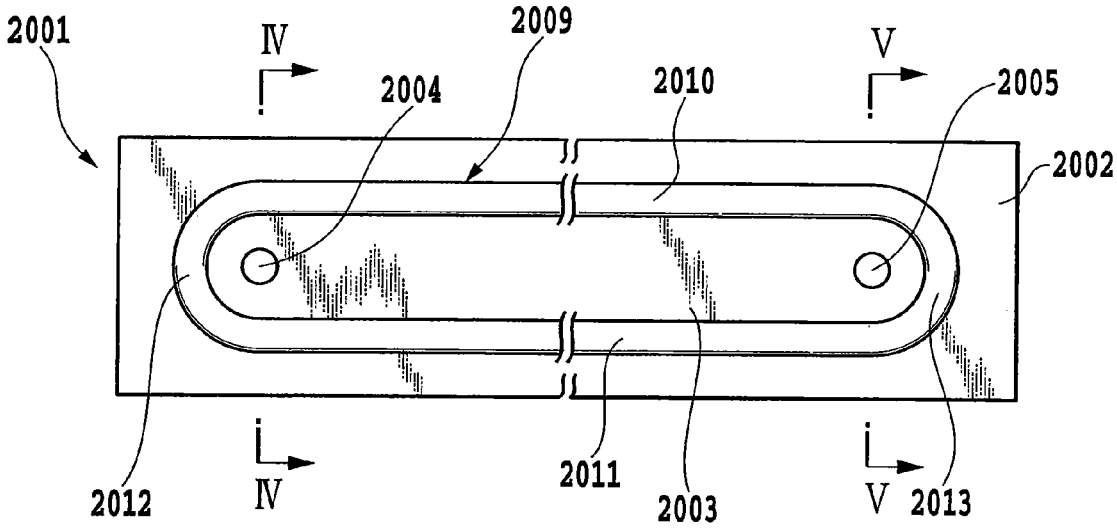
FIG. 3 is a front view of the liquid holding member shown in FIGS. 1 and 2.

As shown in FIG. 3, the liquid holding member 2001 has a space forming base material 2002 and an annular abutting member 2009 located on one surface of the space forming base material 2002. A concave portion 2003 is formed in a central portion of the space forming base material 2002 along its longitudinal direction; a bottom portion of the concave portion 2003 has a circular cross section. The abutting member 2009 has linear portions fastened along the upper edges of the concave portion 2003 and circumferential portions fastened so as to extend from the upper edge through the bottom portion to the opposite upper edge. Thus, when the abutting member 2009 of the liquid holding member 2001 abuts against the applying roller 1001, the abutment conforms to the shape of the peripheral surface of the applying roller. It is thus possible to achieve the abutment at a uniform pressure.

As described above, in the liquid holding member according to this embodiment, the abutting member 2009, formed integrally and seamlessly, is continuously abutted without a gap against the outer peripheral surface of the applying roller 1001 under the biasing force of the spring member 2006. As a result, the liquid holding space S is substantially closed by the abutting member 2009, one surface of the space forming base material, and the outer peripheral surface of the applying roller 1001. The liquid is held in this space. Then, when the rotation of the applying roller 1001 is stopped, the abutting member 2009 and the outer peripheral surface of the applying roller 1001 maintain a liquid tight state. The liquid can be reliably prevented from leaking to the exterior. On the other hand, when the applying roller 1001 is rotated, the application liquid can slipperily flow between the outer peripheral surface of the applying roller 1001 and the abutting member 2009 as described later. In this case, when the applying roller 1001 is stopped and the liquid tight state is established between the outer peripheral surface of the applying roller 1001 and the abutting member 2009, the liquid cannot flow out of the space as described above. In this case, the abutting state of the abutting member 2009 includes not only direct abutment against the outer peripheral surface of the applying roller 1001 but also abutment against the outer peripheral surface via a liquid film formed under a capillary force.

Figure 4:
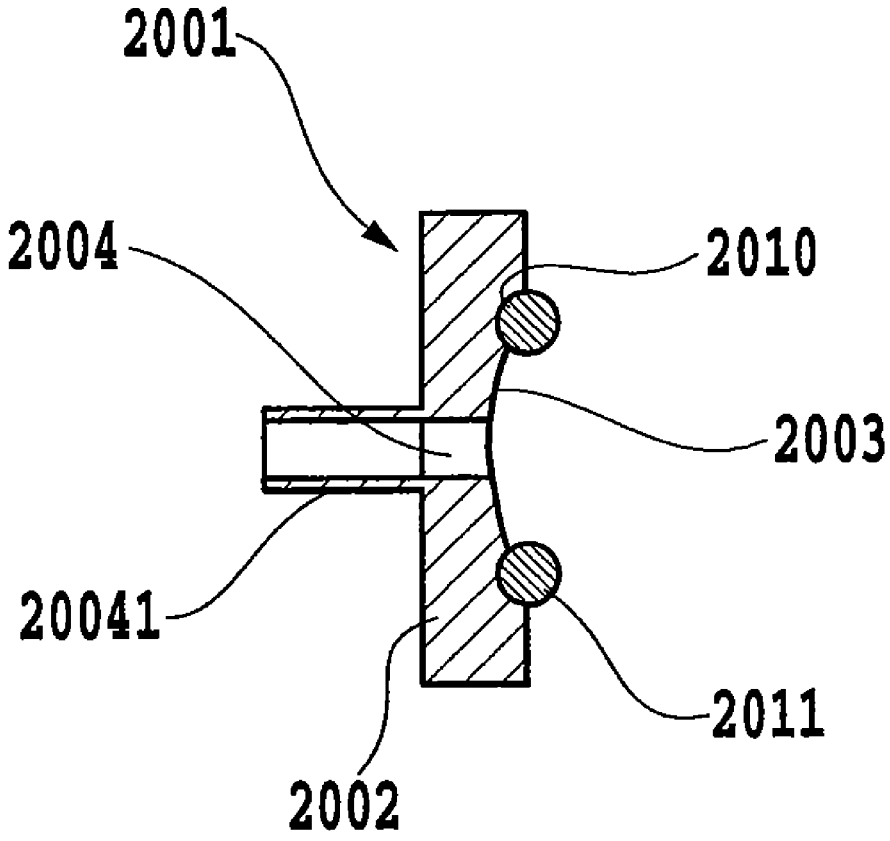
FIG. 4 is an end view showing an end surface of the liquid holding member shown in FIG. 3, the view taken along line IV-IV in FIG. 3.
Figure 5:
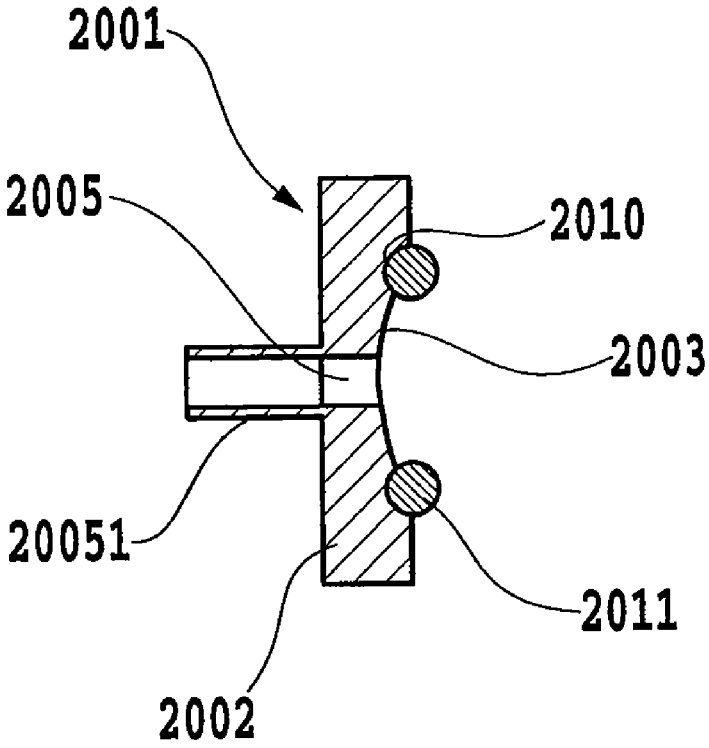
FIG. 5 is an end view showing the end surface of the liquid holding member shown in FIG. 3, the view taken along line V-V in FIG. 3.
Figure 6:
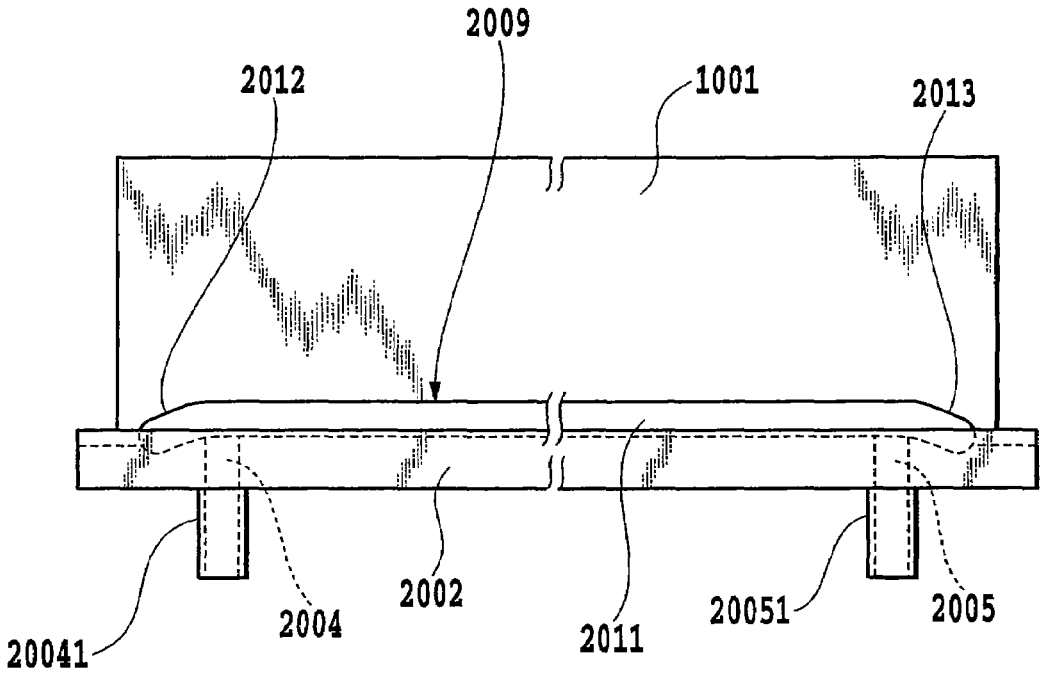
FIG. 6 is a plan view of the liquid holding member shown in FIG. 3.
Figure 7:
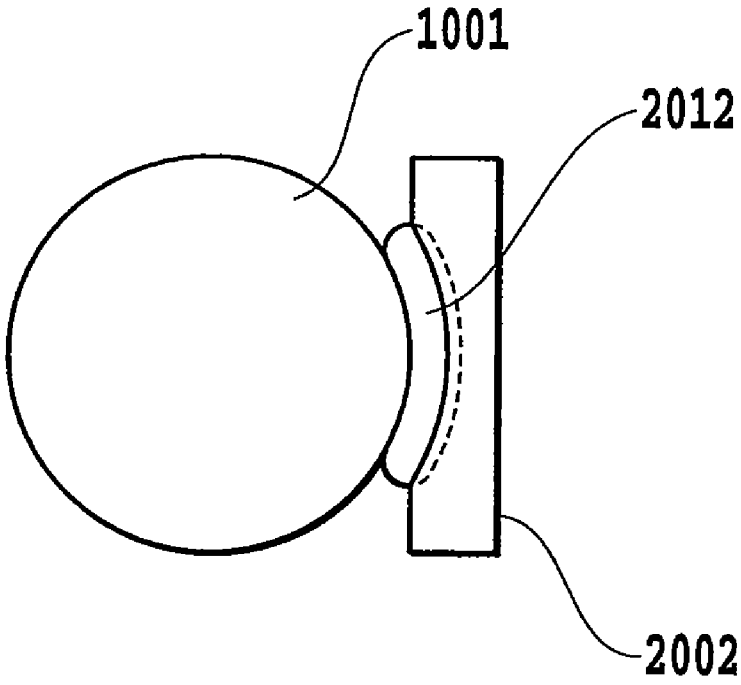
FIG. 7 is a left side view showing how an abutting portion of the liquid holding member shown in FIG. 3 is abutted against a liquid applying roller.
Figure 8:
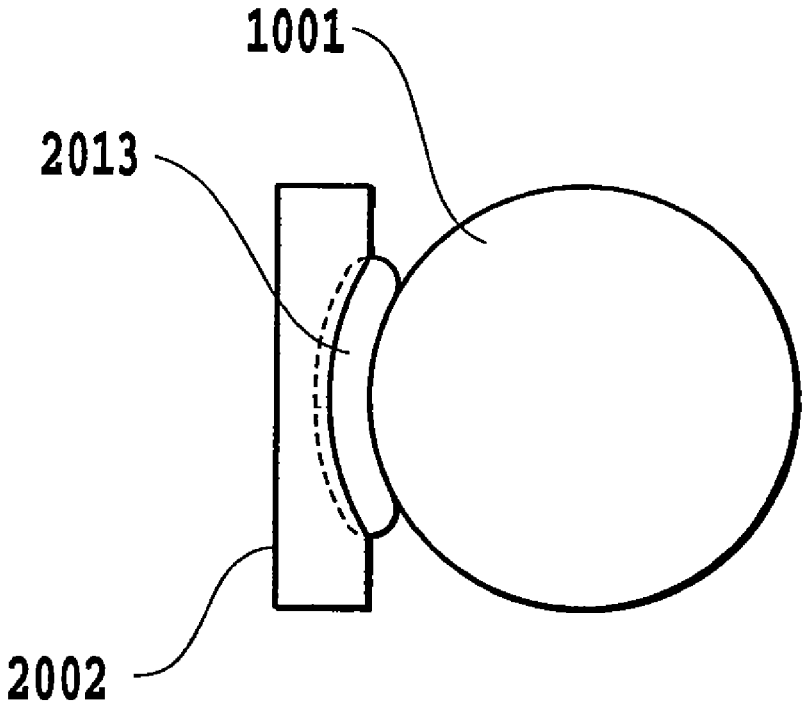
FIG. 8 is a right side view showing how the abutting portion of the liquid holding member shown in FIG. 3 is abutted against the liquid applying roller.

As shown in FIGS. 3 to 8, the longitudinally opposite ides of the abutting member 2009 are gently curved as viewed from its front (FIG. 3), from above (FIG. 6), or from its side (FIGS. 7 and 8). Thus, even when the abutting member 2009 is abutted against the applying roller 1001 under a relatively high pressure, the whole abutting member 2009 is substantially uniformly elastically deformed. This prevents large distortions locally. Thus, as shown in FIGS. 6 to 8, the abutting member 2009 abuts tightly without the gap against the outer peripheral surface of the applying roller 1001. As a result, a substantially closed space can be formed as described above.

On the other hand, as shown in FIGS. 3 to 5, a liquid supplying port 2004 and a liquid collecting port 2005 are formed in an area of the space forming base material 2002 which is surrounded by the abutting member 2009; the liquid supplying port 2004 and the liquid collecting port 2005 have holes penetrating the space forming base material 2002. The liquid supplying port 2004 and the liquid collecting port 2005 are communicating with cylindrical connecting portions 20041 and 20051 projected from a back surface of the space forming base material. Further, the connecting portions 20041 and 20051 are connected to a liquid channel 3000 described later. In this embodiment, the liquid supplying port 2004 is formed near one end of an area surrounded by the abutting member 2009 (the left end in FIG. 3), while the liquid collecting port 2005 is formed near the other end of the same area (the right end in FIG. 3). The liquid supplying port 2004 is used to supply the application liquid provided through the liquid channel 3000, to the liquid holding space S. The liquid collecting port 2005 is used to allow the liquid in the liquid holding space to flow out to the liquid channel 3000. The supply and flow out of the application liquid allows the liquid to flow from the left end to right end of the liquid holding space S.

(Matters Considered in Carrying out the Invention)

The liquid holding space S can maintain a very liquid-tight state but creates the following two problems First, when an area of the applying roller 1001 which has finished applying the liquid to the applying medium returns to the liquid holding space S, the application liquid remaining on the applying roller 1001 without being applied is disadvantageously mixed into the application liquid in the liquid holding space S, together with bubbles. The application liquid remaining on may have a high concentration because of evaporation that may occur when the liquid is exposed to the air during a applying operation. Consequently, when such a application liquid is mixed into the application liquid stored in the liquid holding space S, the concentration of the application liquid increases Therefore, ununiformity of the concentration of the application liquid may arise every applying operation.

Second, the liquid holding space S serves to suppress the evaporation but cannot completely prevent it. Consequently, accumulated evaporations may increase the concentration of the application liquid.

Thus, by circulating the application liquid between the liquid holding space S and the storage tank for the application liquid, the inventors attempted to solve these problems, that is, the mixture of bubbles, the adverse effect of the application liquid remaining on the applying roller without being applied, and an increase in the concentration of the application liquid caused by accumulated evaporations.

Figure 18:
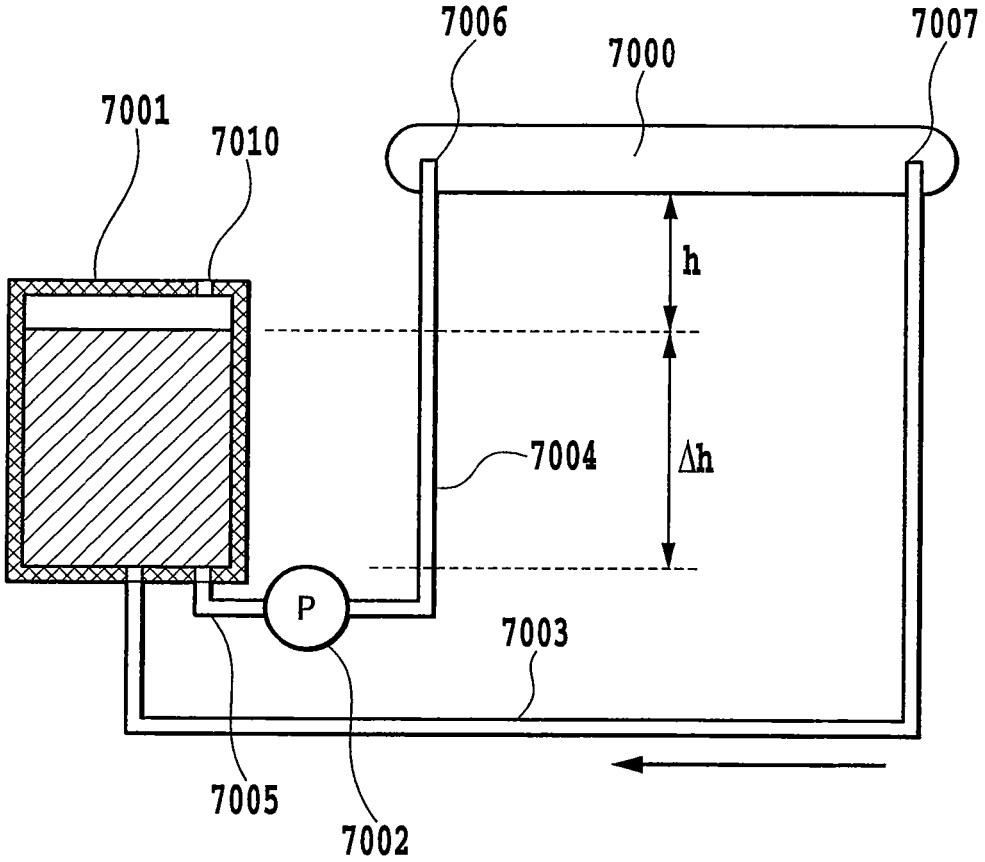
FIG. 18 is a diagram generally showing the configuration of a liquid channel in the liquid applying apparatus according to the embodiment of the present invention.
Figure 19:
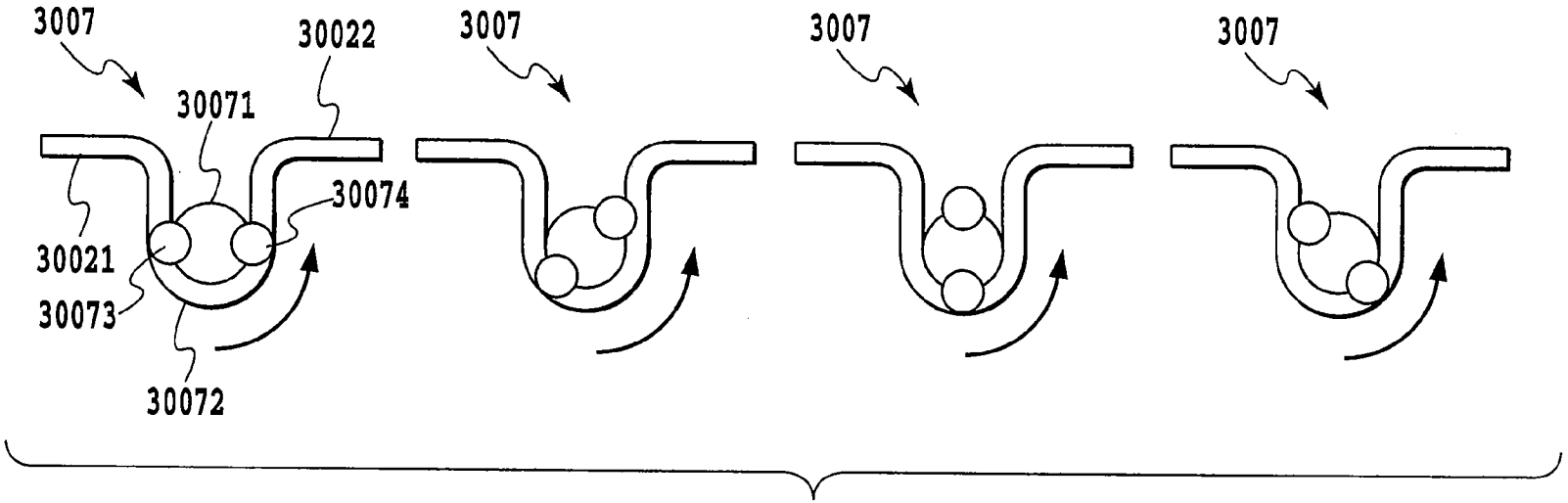
FIG. 19 is a diagram illustrating operations of a pump according to the embodiment of the present invention.

FIG. 18 is a diagram generally showing the configuration of a application liquid supplying system in which a pump is provided between a storage tank and a liquid supplying port of a liquid holding member.

In FIG. 18, reference numeral 7001 denotes a storage tank that stores a application liquid. An air communicating port 7010 is formed in the storage tank 7001. The storage tank 7001 is connected to a pump 7002 via a channel 7005. Further, a liquid holding member 7000 (configured similarly to the above liquid holding member) surrounds a applying roller (not shown) and is provided with a liquid supplying port 7006 and a liquid collecting port 7007. The liquid supplying port 7006 is connected to the pump 7002 via a supply path 7004. Moreover, the storage tank 7001 is connected to the liquid collecting port 7007 via a collecting path 7003.

With this configuration, when the pump 7002 is operated, the application liquid flows from the channel 7005 to the supply path 7004. The flow allows the application liquid to circulate between the storage tank 7001 and the liquid holding space S. In this case, the applying roller is rotated to sequentially supply the application liquid held in the liquid holding member 7000 to a peripheral surface of the applying roller to convey the applying medium to a nip portion between a counter roller (not shown) and the applying roller. This enables a applying operation of applying the application liquid on the peripheral surface of the applying roller to the medium. If the pump 7002 is placed on the liquid supplying port 7006 side, when the application liquid is circulated, the pressure at the liquid supplying port 7006 is relatively higher than that at the liquid collecting port 7007. Accordingly, the circulation carried out with the above configuration is based on a pressurizing system.

A detailed description will be given of conditions for preventing the leakage of the liquid from the liquid holding member 7000 of the pressurizing system-based application liquid supplying system. The description will use an internal pressure Pin at the liquid supplying port 7006 and an internal pressure Pout at the liquid collecting port 7007. Here, the atmospheric pressure is defined as P0, the specific gravity of the application liquid is defined as ρ, and a gravitational acceleration is defined as g. A difference in water head between the level in the storage tank 7001 and the applying mechanism 1000 is defined as h. A fluid resistance (flow resistance) between the liquid supplying port 7006 and liquid collecting port 7007 in the liquid holding member 7000 is defined as R. A fluid resistance (flow resistance) between the opposite ends of the collecting path 7003 is defined as Rout. Further, a flow velocity in the supply path 7004, liquid holding member 7000, and collecting path 7003 is defined as I. Then, the following equations are established.

$$Pout=P0-\rho\times g\times h+Rout\times I \quad (1)$$

$$Pin=P0-\rho\times g\times h+(Rout+R)\times I \quad (2)$$

If such a flow of the application liquid is created, the internal pressure of the liquid holding member 7000 must be lower than the atmospheric pressure P0, an external air pressure, in order to prevent the leakage of the application liquid from the liquid holding member 7000. Pout<Pin is apparent from Equations (1) and (2). Accordingly, Pin<P0 is a condition for reducing the internal pressure of the liquid holding member 7000 below the external air pressure P0.

That is, the following expression is derived on the basis of Pin<P0 and (Equation 2).

$$I<(\rho\times g\times h)/Rout+R) \quad (3)$$

The condition shown in (Expression 3) is a relationship observed if the application liquid does not flow out of the liquid holding member 7000 for applying. The condition corresponds to the case where the applying roller is at as top. On the other hand, the pump 7002 is provided between the storage tank 7001 and the liquid supplying port 7006. That is, since the circulation is based on pressurization, the liquid holding member 7000 must be supplied with a application liquid the amount of which is equal to that of application liquid already used for applying in order to circulate the application liquid while performing a applying operation. Specifically, to sense the amount of application liquid used for applying, for example, a sensor or the like must be provided as level managing means for sensing the level in the liquid holding member 7000. The pump 7002 must then be controlled taking into account the amount of application liquid used for a applying operation, the amount being obtained from sensed information from the sensor. Without this control, the pump 7002 must create a flow at a maximum flow velocity Imax on the assumption that the largest amount of application liquid is used in the liquid holding means 7000 for a applying operation. Expression (3) may be met with the maximum flow velocity Imax. Accordingly, on the basis of Expression (3), the maximum flow velocity Imax, which is equivalent to the largest amount of application liquid, must meet the following condition.

$$Imax<(\rho\times g\times h)/(Rout+R) \quad (4)$$

Expression (4) Indicates that the difference in water head h between the level in the storage tank 7001 and the liquid holding member 7000 must be regulated in order to obtain a certain flow velocity. In other words, the positional relationship between the storage tank 7001 and the liquid holding member 7000 is regulated.

Further, to meet Expression (4), it is necessary to reduce the fluid resistance (flow resistance) between the liquid holding member 7000 and the collecting path 7003. In general, the surface area for the flow is increased or the length of the channel is reduced in order to lower the flow resistance. The length of the liquid holding member 7000 is substantially determined by the width of the applied area of the applying medium. The length of the collecting path 7003 is substantially determined by the distance between the liquid holding member 7000 and the storage tank 7001. When the cross section of the liquid holding member 700 or collecting path 7003 is Increased with its length remaining unchanged, its volume is increased. The increase in volume makes it difficult to reduce the size of the apparatus.

As described above, if the pump is provided between the storage tank and the liquid holding member and the circulation is based on the pressurizing system, the water head difference h must be regulated in order to prevent the leakage of the liquid from the liquid holding member. It is also necessary to reduce the flow resistance of the liquid holding member and the collecting path. Further, when an increase in the size of the apparatus is taken into account, an increase in water head difference h and a reduction in the flow resistance of the liquid holding member and the collecting path are limited. It is thus difficult to increase the maximum flow velocity Imax. Moreover, by providing the liquid holding member with a sensor or the like which senses the amount of application liquid used for applying, it is necessary to control the pump so that the liquid holding member is supplied with a application liquid the amount of which is equal to that expected to be consumed, while the application liquid is circulated at a predetermined flow velocity. Without this control, the pump may cause the application liquid to always flow at the maximum flow velocity Imax. However, if only a small amount of application liquid is consumed, an excessive amount of application liquid is supplied to pressurize the liquid holding member. This may lead to the leakage of the liquid.

The present invention is made in view of the matters described above. Several embodiments of the present invention will be described below.

First Embodiment

According to the present embodiment, a pump is provided between a liquid collecting port in a liquid holding member and a storage tank. A decompression system is used to circulate a application liquid between the liquid holding member and the storage tank.

(Application Liquid Channel)

Figure 11:
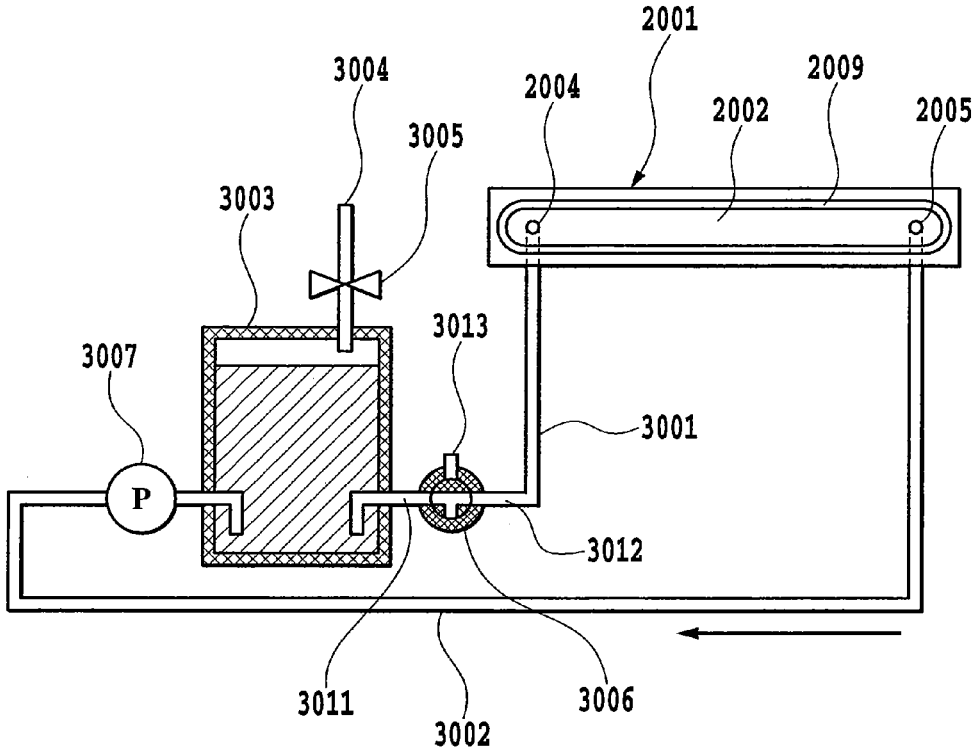
FIG. 11 is a diagram generally showing the configuration of a liquid channel in the liquid applying apparatus according to the embodiment of the present invention.

FIG. 11 is a diagram generally illustrating the configuration of the liquid channel 3000, connected to the liquid holding member 2001 of the application liquid supplying means.

The liquid channel 3000 has a first channel 3001 that connects the liquid supplying port 2004 of the space forming base member 2002, constituting the liquid holding member 2001, to a storage tank 3003 that stores the application liquid, a second channel 3002 that connects the liquid collecting port 2005 of the space forming base material 2002 to the storage tank 3003 together. An air communicating port 3004 is formed in the storage tank 3003. The air communicating port is provided with an air communicating valve 305 that selectively enables and disables the communication between the port and the air. The air communicating port 3004 desirably has a labyrinthine structure in order to inhibit evaporation. Further, the first channel 3001 is provided with a selector valve 3006. The selector valve 3006 selectively enables and disables the communication between the first channel 3001 and the air. Moreover, the second channel 3002 connects to a pump 3007 used to force the application liquid and air to flow through the liquid channel 3000 in a desired direction. In this case, a flow of a liquid is generated which is directed from the first channel 3001 to the second channel 3002 via the liquid holding space S.

In this embodiment, the first channel 3001 and the second channel 3002 are formed of cylindrical tubes. An opening formed at an end of each tube is placed at the bottom of the storage tank 3003 or close to the bottom. The position of the opening allows the application liquid in the storage tank 3003 to be completely consumed.

The pump 3007 according to this embodiment is composed of a tube pump shown in FIG. 18. The tube pump 3007 has a rotor 30071 rotated by a pump driving motor (not shown), a flexible pump constituting tube 30072 circularly disposed along the outside of the rotor 30071., and two rollers 30073 and 30074 rotatively movably supported by the rotor 30071. With this tube pump, the rotor 30071 rotates to allow at least one of the rollers 30072 and 30074 to roll while squeezing the pump constituting tube 30072. This rolling drives the application liquid or air in the pump constituting tube 30072 downstream (in FIG. 18, to the storage tank tube 30022), while sucking the application liquid or air from a liquid holding member tube 30021. Further, while the driving of the tube pump 3007 is at a stop, the tube pump 3007 remains inactive while squeezing the pump constituting tube. Consequently, the communication between the tube 30021 and the tube 30022 is shut off.

Figure 22:
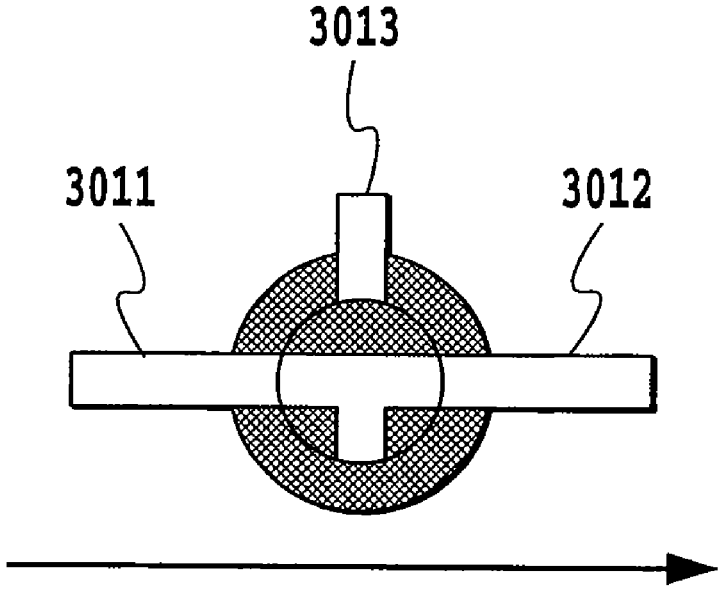
FIG. 22 is a diagram showing how a three-way valve 3006 is used to communicate tubes 3011 and 3012 with each other.
Figure 23:
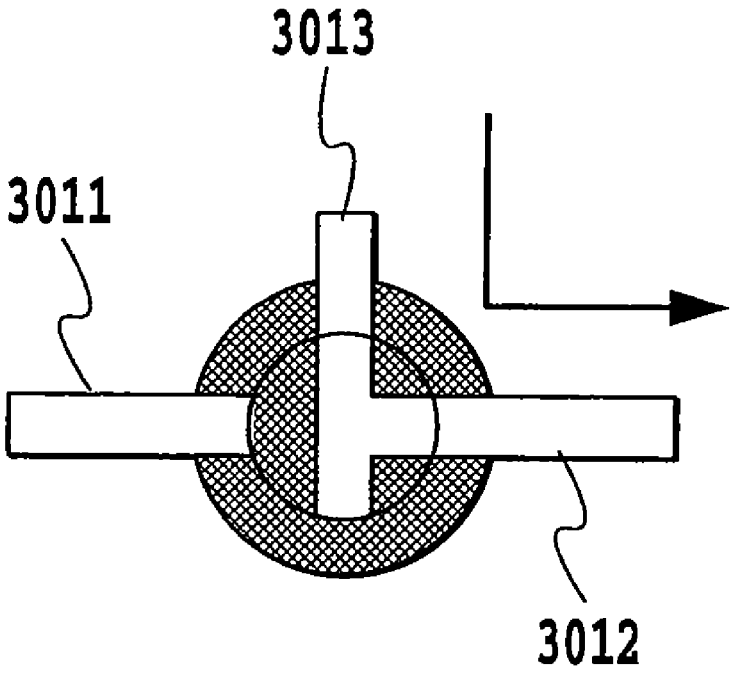
FIG. 23 is a diagram showing how the three-way valve 3006 is used to communicate the tube 3012 and an air communicating port 3013 with each other.

According to this embodiment, various types of the selector valves 3006 are applicable provided that they selectively enable and disable the communication between the first channel 3001 and the air. In this case, a three-way valve is used as shown in FIG. 11. The three-way valve 3006 has three ports that are in communication with one another. It is possible to allow two of the three ports to selectively communicate with any two of the storage tank tube 3011, liquid holding member tube 3012, and air communicating port 3013 in the first channel 3001. The three-way valve 3006 allows the selective switching between a connected state in which the tubes 3011 and 3012 are in communication and a connected state in which the tube 3012 and the air communicating port 3013 are in communication. This enables the application liquid in the storage tank 3003 or air obtained through the air communicating port 3013 to be selectively supplied to the space S formed by the liquid holding member 2001 and the applying roller 1001. Specifically, while the tubes 3011 and 3012 are in communication as shown in FIG. 22, the application liquid in the storage tank 3003 is supplied to the Liquid holding space S. On the other hand, while the tube 3012 and the air communicating port 3013 are in communication as shown in FIG. 23, the air obtained through the air communicating port 3013 is supplied to the liquid holding space S. The switching of the three-way valve 3006 is carried out in accordance with a control signal from a control section 4000 described later. Thus, the application liquid is filled or supplied.

In this manner, the pump is provided on the collecting side of the liquid holding member 2001. Accordingly, when the application liquid is circulated, the pressure at the liquid collecting port 2005 is relatively lower than that at the liquid supplying port 2004. This serves to accomplish circulation based on a decompression system. The decompression system according to the present embodiment relatively reduces the pressure at the liquid collecting port 2005 below that at the liquid supplying port 2004. The decompression system according to the present embodiment does not use the atmospheric pressure or a predetermined value as a determination criterion.

(Control System)

Figure 12:
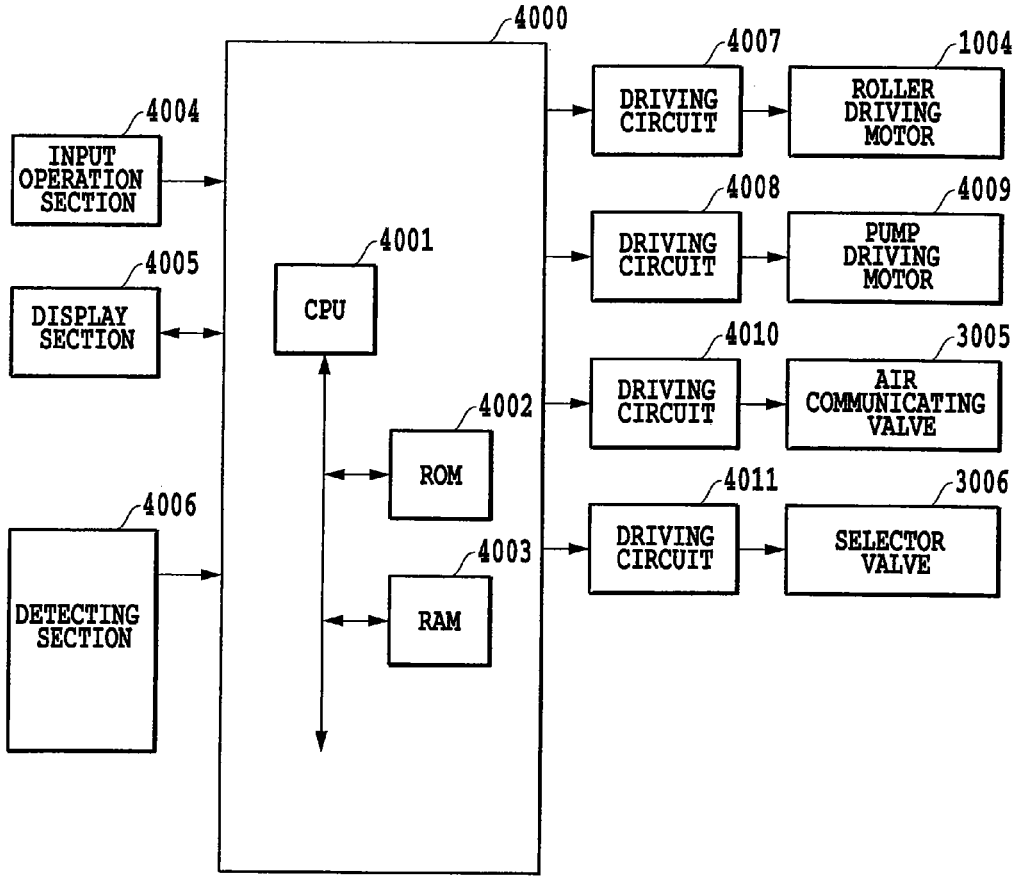
FIG. 12 is a block diagram generally showing the configuration of a control system according to the embodiment of the present invention.

FIG. 12 is a block diagram generally showing the configuration of the control system in the liquid applying apparatus according to the present embodiment.

In FIG. 12, the control section 4000 operates as control means for controlling the whole liquid applying apparatus The control section 4000 has a CPU 4001 that performs various process operations such as calculations, control, and determinations, a ROM 4002 that stores, for example, control programs for processes executed by the CPU 4001, such as the one described later In FIG. 13, and a RAM 4003 that temporarily stores data used during process operations of the CPU 40011 as well as input data.

The control section 4000 connects to an input operation section 4004 including a keyboard, various switches, or the like with which predetermined instructions or data are input, a display section 4005 that provides various displays including inputs to and the set state of the liquid applying apparatus, and a detecting section 4006 including a sensor or the like which detects the position of a applying medium or the operational state of each section. The control section 4000 also connects to the roller driving motor 1004, a pump driving motor 4009, an air communicating valve 3005, and the selector valve 3006, via driving circuits 4007, 4008, 4010, and 4011.

(Liquid Applying Operation Sequence)

Figure 13:
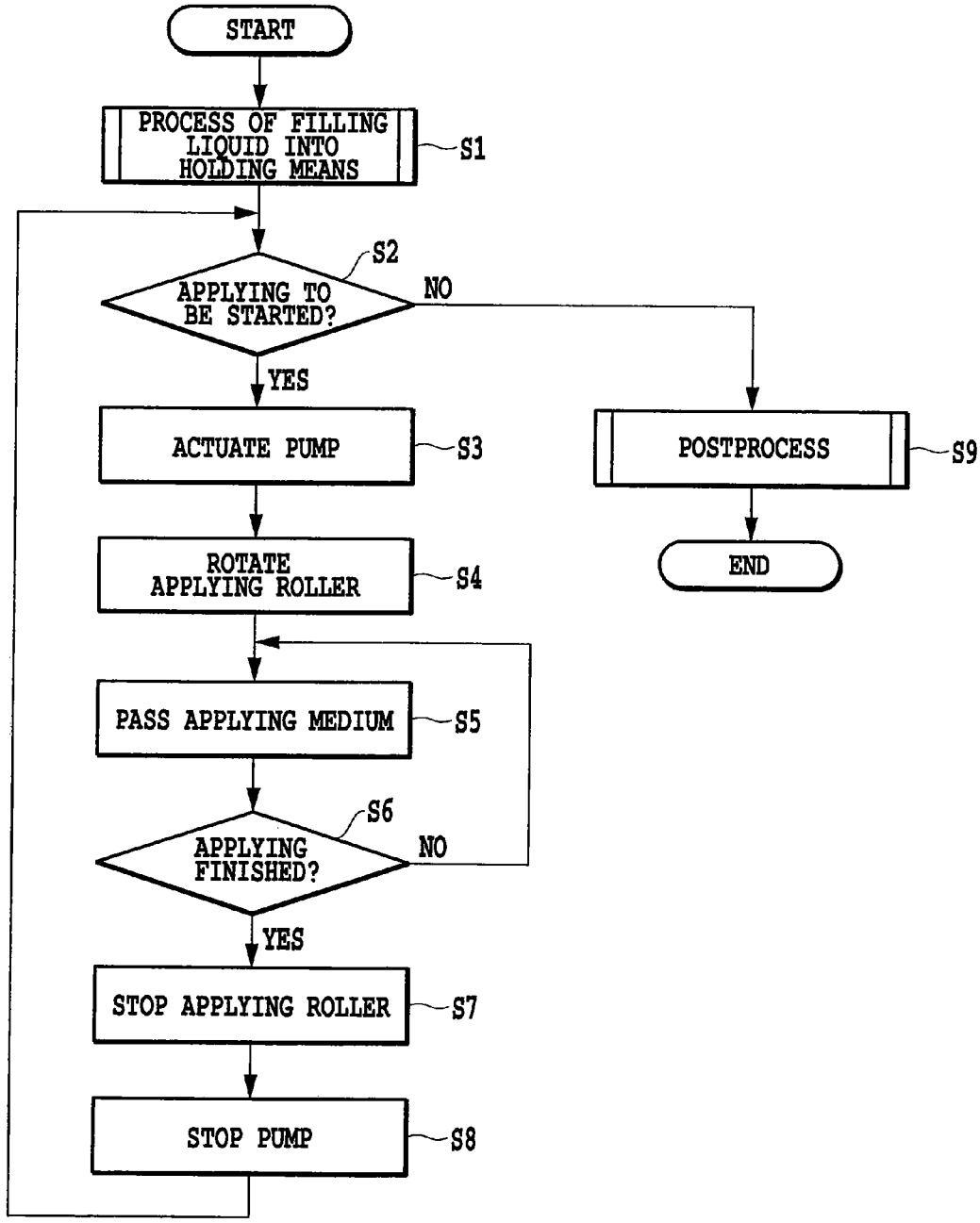
FIG. 13 is a flowchart showing a liquid applying operation sequence according to the embodiment of the present invention.

FIG. 13 is a flowchart showing a process procedure for applying a liquid in the liquid applying apparatus according to the present embodiment. The steps of liquid application will be described below with reference to this flowchart When the liquid applying apparatus is powered on, the control section 4000 executes a applying operation sequence described below, in accordance with the flowchart shown in FIG. 13.

Filling Step

In step S1, the liquid holding space S is filled with the application liquid. In this filling step, the air communicating valve 3005 of the storage tank 3003 is first opened to the air. The pump 3007 is driven for a specified time. Accordingly, if the liquid holding space S and the channels 3001 and 3002 have not been filled with the application liquid, the pump drives the air inside the space and channels out to the storage tank 3003. The air is then discharged to the exterior of the apparatus. These portions are then filled with the application liquid. On the other hand, if these portions have already been filled with the application liquid, the application liquid in these portions starts to flow. These portions are thus supplied with a application liquid having an appropriate concentration and viscosity. This initial operation allows the application liquid to be supplied to the applying roller 1001. It is thus possible to apply the application liquid to a applying medium.

Applying Step

Then, a applying start instruction is input (step S2). Then, the pump 3007 restarts operation (step S3). The applying roller starts rotating clockwise as shown by an arrow in FIG. 1 (step S4). The rotation of the applying roller 1001 causes the application liquid L filled into the liquid holding space S to slipperily flow between the applying roller 1001 and a lower edge 2011 of the abutting member 2009 against the pushing force of the abutting member 2009 of the liquid holding member 2001, which force acts on the applying roller 1001. The application liquid adheres to the outer periphery of the applying roller 1001 in layer form. The application liquid L adhering to the applying roller 1001 is transferred to the abutting portion between the applying roller 1001 and the counter roller 1002.

Figure 9:
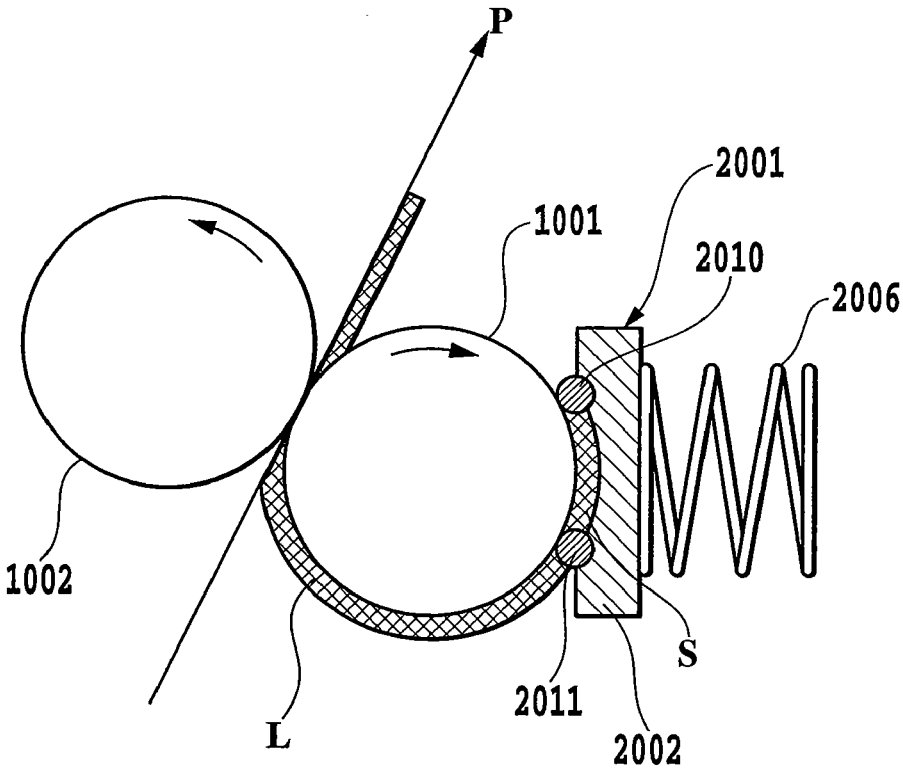
FIG. 9 is a vertical sectional view showing how an application liquid is filled into a liquid holding space formed by the liquid holding member and the applying roller and how a liquid is applied to an applying medium by the rotation of the applying roller.

Then, a applying medium supplying mechanism 1006 conveys a applying medium to between the applying roller 1001 and the counter roller 1002. The applying medium is inserted between these rollers and conveyed to a sheet discharging section as the applying roller 1001 and the counter roller 1002 rotate (step S5). During this conveyance, the application liquid applied to the peripheral surf ace of the applying roller is transferred from the applying roller 1001 to the applying medium P as shown in FIG. 9. Of course, means for supplying a applying medium to between the applying roller 1001 and the counter roller 1002 is not limited to the above supplying mechanism. It is possible to use any means, for example, manual means which uses a predetermined guide member or which is solely used.

In FIG. 9, an area with crossing oblique lines denote the application liquid L. In this case, the application liquid on the applying roller 1001 and applying medium P is shown considerably thicker than the actual one in order to clearly illustrate how the application liquid L is applied.

As described above, a applied part of the applying medium P is conveyed in the direction of the arrow under the conveying force of the applying roller 1001. Further, an unapplied part of the applying medium P is conveyed to the contact portion between the applying medium P and the applying roller 1001. This operation is continuously or intermittently performed to apply the application liquid to the entire applying medium.

FIG. 9 shows the ideal applied state in which the all of the apple cation liquid L adhering to the applying roller 1001 after slipperily flowing out of the abutting member 2009 is transferred to the applying medium P. However, actually, not all of the application liquid L adhering to the applying roller 1001 is not transferred to the applying medium P. Specifically, when the applying medium P conveyed separates from the applying roller 1001, the application liquid L often also adheres to and remains on the applying roller 1001. The amount of application liquid L remaining on the applying roller 1001 varies depending on the material of the applying medium P or the state of fine concaves and convexes on the surface of the applying medium P. However, if the applying medium P is ordinary paper, the application liquid L remains on the peripheral surface of the applying roller 1001 after a applying operation.

Figure 25:
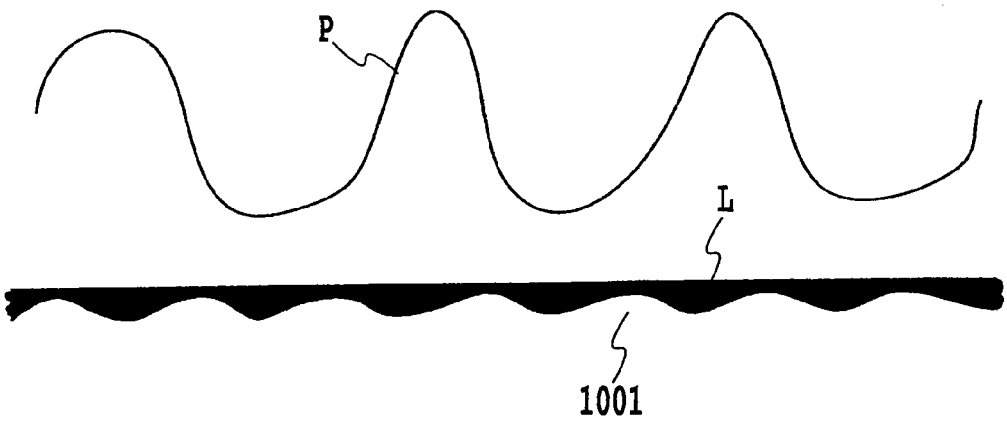
FIG. 25 is a diagram illustrating an applying process executed on a surface of a medium P and an applying surface if the medium is ordinary paper.
Figure 26:
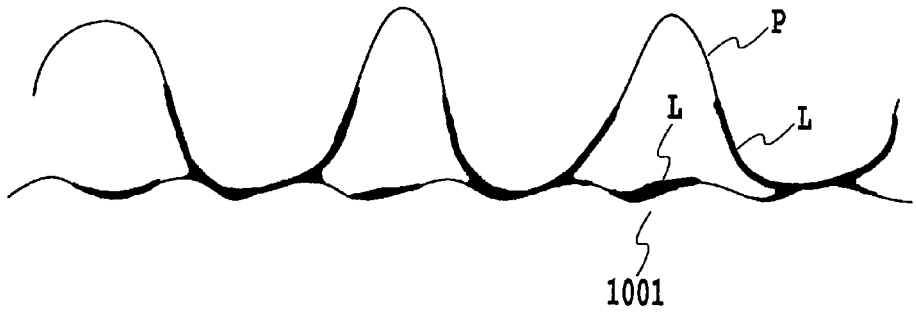
FIG. 26 is a diagram illustrating the applying process executed on the surface of the medium P and the applying surface if the medium is ordinary paper.
Figure 27:
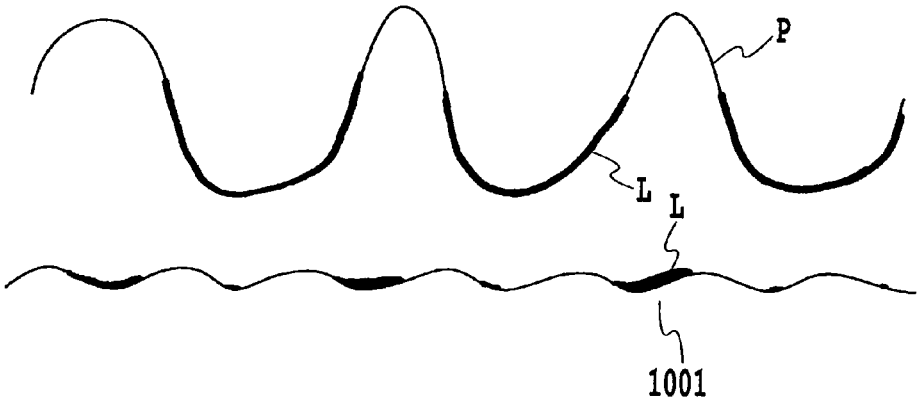
FIG. 27 is a diagram illustrating the applying process executed on the surface of the medium P and the applying surface if the medium is ordinary paper.

FIGS. 25, 26, and 27 are diagrams illustrating the process of applying between a surface of the medium P and a applying surface in the case where the medium is ordinary paper. In these figures, the liquid is painted over with black.

FIG. 25 shows the state of the upstream side of the nip portion between the applying roller 1001 and the counter roller 1002. In this figure, the liquid adheres to the applying surface of the applying roller 1001 so as to slightly cover the fine concaves and convexes on the applying surface.

FIG. 26 shows the state of the surface of ordinary paper, the medium P, and the applying surface of the applying roller 1001, at the nip portion between the applying roller 1001 and the counter roller 1002. In this figure, the convexes on the surface of the ordinary paper, the medium P, contact with the applying surface of the applying roller 1001. The liquid instantaneously permeates through or sticks to fibers in the surface of the ordinary paper, the medium P, through the contacting parts. The liquid adhering to those parts of the applying surface of the applying roller which do not contact with the convex portions on the surface of the ordinary paper remains on the applying surface.

FIG. 27 shows the state of the downstream side of the nip portion between the applying roller 1001 and the counter roller 1002. In this figure, the medium has completely left the applying surface of the applying roller 1001. The liquid adhering to those parts of the applying surface of the applying roller 1001 which do not contact with the convex portions on the surface of the ordinary paper remains on the applying surface. The liquid on the contacting parts also remains with very small amount on the coating surface.

The application liquid remaining on the applying roller 1001 slipperily flows between the applying roller 1001 and the upper edge 2010 of the abutting member 2009 and returns to the liquid holding space S, against the pushing force of the abutting member 2009 of the liquid holding member 2001, which force acts on the applying roller 1001. The application liquid is then mixed with the application liquid filled into the space S.

Figure 10:
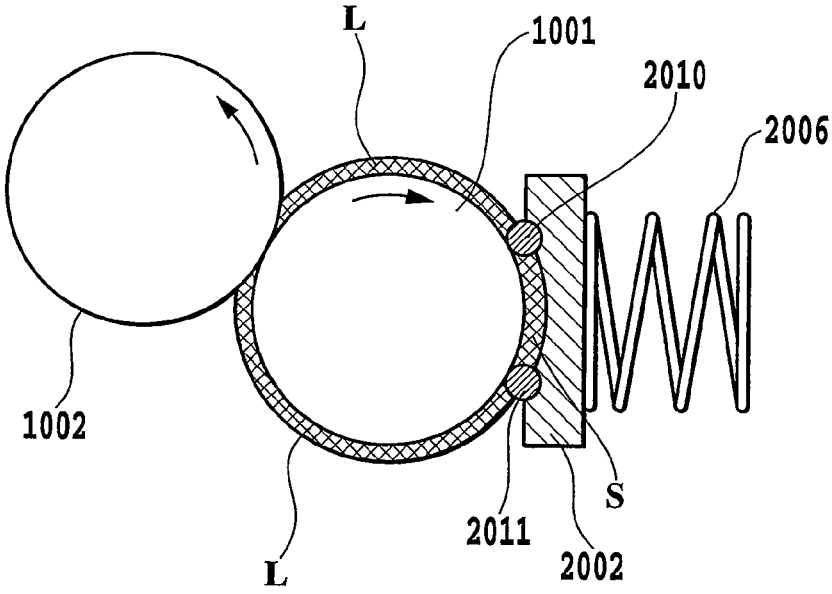
FIG. 10 is a vertical sectional view showing how the application liquid is filled into the liquid holding space formed by the liquid holding member and the applying roller and how the applying roller is rotated when no applying medium is present.

It is difficult to accurately stop the applying roller 1001 when no applying medium is present in the nip portion and to avoid the situation in which the width of the applying medium precludes the presence of the applying medium in the nip portion. However, the operation of returning the application liquid is also performed if the applying roller 1001 is rotated when no applying medium is present as shown in FIG. 10. The application liquid adhering to the outer periphery of the applying roller 1001 as a result of the rotation of the applying roller 1001 slipperily flows through the abutting portion between the applying roller 1001 and the counter roller 1002. After flowing through the abutting portion, the application liquid is separated into two parts directed to the applying roller 1001 and the counter roller 1002, respectively. The application liquid remains on the applying roller 1001. Then, the application liquid L adhering to the applying roller 1001 slipperily flows between the upper edge 2010 of the abutting portion 2009 and the applying roller 1001 to enter the liquid holding space S. The application liquid is then mixed with the application liquid filled into the space S.

Figure 28:
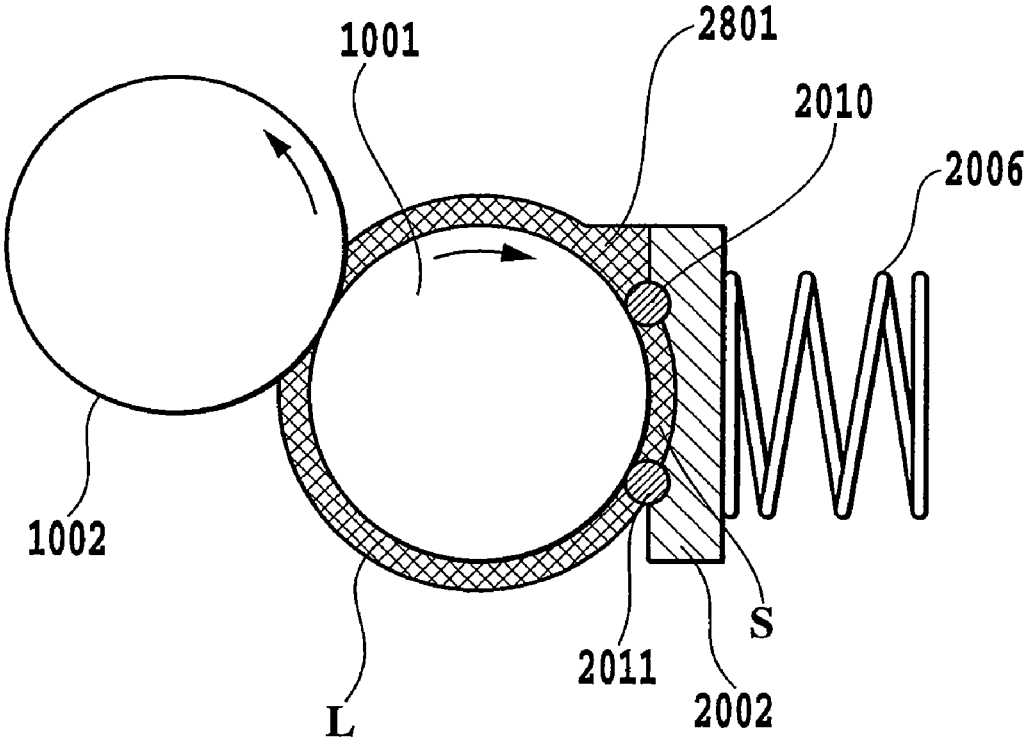
FIG. 28 is a vertical sectional view showing how the application liquid is filled into the liquid holding space formed by the liquid holding member and the applying roller and how the applying roller is rotated while the pump is at a stop and when no applying medium is present.

However, when the difference in pressure between the liquid holding space S and the air is insufficient, the amount of application liquid entering the liquid holding space S is limited. Specifically, in the application liquid returning action when the applying medium is absence, if the pump 3007 is not operated, the difference in pressure between the liquid holding space S and the air decreases, This reduces the amount of application liquid L slipperily flowing between the upper edge 2010 of the abutting member 2009 and the applying roller 1001. As a result, a pool 2801 of the application liquid L is formed on the applying roller 1001 and on the top of upper edge 2010 of the abutting member 2009 as shown in FIG. 28. The application liquid collected drips from the opposite ends of the space forming base material 2002 or the opposite ends of the applying roller.

Means for making a difference in water head between the liquid holding space S and the level in the storage tank 3003 can be used as means for making a sufficient difference in pressure between the liquid holding space S and the air even if the pump 3007 is not operated. However, making a difference in water head may creates the following problems; a variation in the amount of liquid held in the storage tank 3003 may vary the water head difference or the degree of freedom in the installation of the storage tank 3003 is limited.

Thus, not only during a applying operation but also during a non-applying operation (for example, the case in which no applying medium is present in the nip portion), the pump 3007 is preferably operated to make an appropriate difference in pressure between the liquid holding space and the air.

Ending Step

Once the operation of applying the liquid to the applying medium has been performed as described above, the apparatus determines whether or not to finish the applying step. If the applying step is not to be finished, the process returns to step S5 to repeat the applying operation until the applying step is executed on the all the parts of the applying medium to which the liquid needs to be applied. When the applying step is finished, the applying roller 1001 is stopped (step S7). Moreover, the driving of the pump 3007 is stopped (step S8) Subsequently, the process shifts to step S2 to repeat the operations from step S2 to step S8 unless an applying start instruction is input before a predetermined period elapses. Even after the predetermined period has elapsed, if the applying start instruction is not input, a postprocess is executed such as a collecting operation of collecting the application liquid from the liquid holding space S and liquid channels (step S9). Then, the coating process is finished.

Collecting Operation

Now, with reference to FIG. 24, description will be given of a application liquid collecting operation shown in step s9 and performed as a postprocess. This collecting operation is performed by opening the air communicating valve 3005 and the air communicating port 3013 and driving the pump 3007 to cause the application liquid in the tube 3012 of the first channel 3001 and in the liquid holding space S and second channel 3002 to flow into the liquid storing tank 3003. This will be described below in detail.

Immediately before the collecting operation is started, the applying roller 1001 and the pump 3007 are at a stop. Further, the air communicating valve 3005 is open, while the air communicating port 3004 is open to the air.

Figure 24:
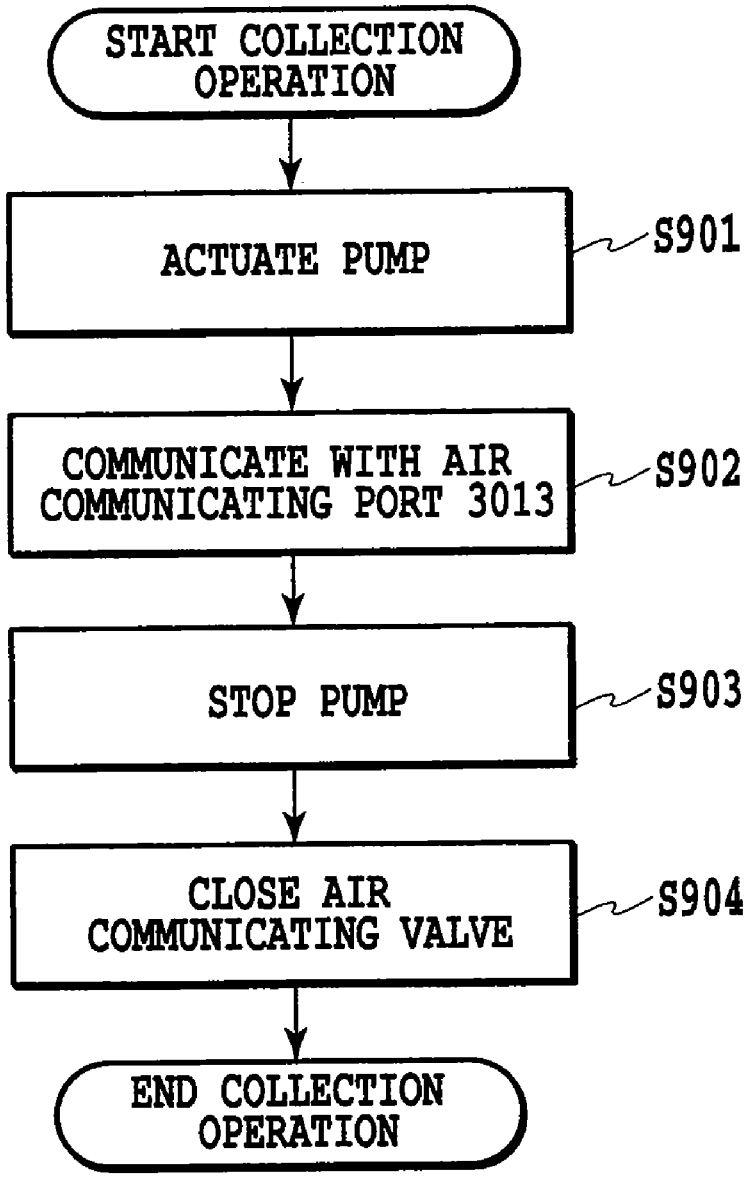
FIG. 24 is a flowchart showing the sequence of a collecting operation.

When the collecting operation is started, the pump 3007 is operated in step S901 in FIG. 24 to create a flow of the application liquid in the liquid channel 3000. For example, the direction of flow of the application liquid in the second channel 3002 is as shown by an arrow in FIG. 11.

Then, in step S902, the three-way valve 3006 is set as shown in FIG. 23 to allow the air communicating port 3013 and the liquid holding member tube 3012 to communicate with each other. Then, since the application liquid is already flowing in the direction shown by the arrow in FIG. 11 as a result of the operation of the pump 3007, air flows in through the air communicating port 3013 as the application liquid flows. Accordingly, the application liquid present in the path (also referred to as the liquid channel A below) from the liquid holding member tube 3012 containing the liquid holding space S to the second channel 3002 is collected to the storage tank 3003. Further, the liquid channel A is filled with air. Furthermore, the three-way valve 3006 is operated as shown in FIG. 23. As a result, the storage tank tube 3011 is shut off from the air.

Then, in step S903, the operation of the pump 3007 is stopped. The pump 3007 is then used to shut off the second channel 3002 from the air. Finally, in step S904, the air communicating valve 3005 is closed.

With this configuration, if the applying operation has not been performed for a predetermined or longer period, the application liquid is collected from the liquid channel A. Accordingly, even if the applying operation is not preformed for a long time, the application liquid is not evaporated and fixed in the liquid holding space S in the liquid channel A. This prevents unsatisfactory applying caused by the fixture of the application liquid to the abutting member 2009.

Further, this collecting operation makes it possible to prevent the application liquid from being evaporated from the liquid holding space S After the collecting operation, the air communicating valve 3005 is closed and the selector valve 3006 is switched to disable the communication between the storage tank tube 3011 and the air communicating port 3013. The storage tank 3003 is thus shut off from the air this reduces the evaporation of the application liquid from the storage tank 3003. As previously described, the application liquid in the liquid channel A, which is in communication with the air, is collected to the storage tank 3003. Since the storage tank 3003 is shut off from the air, the application liquid can be prevented from flowing out of the apparatus even if the posture of the apparatus is tilted during movement, transportation, or the like.

In the description of the flowchart shown in FIG. 13, in step S8, the pump 3007 is stopped. Then, if the applying start instruction is not input even after a predetermined time has elapsed, the process shifts to the collecting operation in step S9. However, the present embodiment is not limited to this form For example, the collecting operation can be performed by shifting from the stoppage of the applying roller in step S7 in FIG. 13 to the operation in step S902 in FIG. 24 without performing the operation of halting the pump 3007 in step S8 in FIG. 13.

In the present form, the process shifts to step S5 when the applying start signal is input within a predetermined period after the applying operation in step S6 in FIG. 13. On the other hand, if the applying start signal is not input within the predetermined period, the process shifts to step S7. Then, in step S7, the applying roller 1001 is stopped. However, at this time, the pump 3007 is in operation. Accordingly, the process skips step S901 in FIG. 24 and shifts to step S902 in FIG. 24 to start an operation of collecting the application liquid. Subsequently, as described above, steps S903 and S904 are executed to finish the application liquid collecting operation.

A detailed description will be given of conditions for preventing the leakage of the liquid from the liquid holding member 2001 of the application liquid supplying system according to the present embodiment. The description will use an internal pressure Pin at the liquid supplying port 2004 and an internal pressure Pout at the liquid collecting port 2005. Here, the atmospheric pressure is defined as P0, the specific gravity of the application liquid is defined as ρ, and the gravitational acceleration is defined as g. A difference in water head between the level in the storage tank 3003 and the liquid holding member 2001 is defined as h. A fluid resistance (flow resistance) between the liquid supplying port 2004 and liquid collecting port 2005 of the liquid holding member 2001 is defined as R. A fluid resistance (flow resistance) between the opposite ends of the first channel 3001, a supply path, is defined as Rin. Further, a flow velocity in the first channel 3001, liquid holding member 2001, and second channel 3002 is defined as I. Then, the following equations are established.

$$Pout=P0-\rho\times g\times h-(Rin+R)\times I \quad (5)$$

$$Pin=P0-\rho\times g\times h-Rin\times I \quad (6)$$

If such a flow of the application liquid is created, the internal pressure of the liquid holding member 2001 must be lower than the atmospheric pressure P0, an external air pressure, in order to prevent the leakage of the application liquid from the liquid holding member 2001. Pout<Pin is apparent from Equations (5) and (6). Accordingly, Pin<P0 is a condition for reducing the internal pressure of the liquid holding member 2001 below the external air pressure P0, that is, preventing the leakage of the application liquid. That is, on the basis of Pin<P0 and Equation (6), the following relationship is a condition for preventing the leakage of the application liquid from the liquid holding member 2001.

$$I>-(\rho\times g\times h)/Rin \quad (7)$$

In this case, $\rho>0$, $g>0$, and $Rin>0$, so that Expression (7) is always established provided that the water head difference $h \geqq 0$.

On the other hand, a condition for obtaining the water head difference $h<0$ is established when the level in the storage tank 3003 is higher than that in the liquid holding member 2001. That is, the flow resistance between the liquid holding member 2001 and the first channel 3001 need not be taken into account as in the case of the pressurizing system described in connection with the matters to be considered. Accordingly, the leakage of the application liquid can be prevented simply by restricting the positional relationship between the storage tank 3003 and the vertical direction of the liquid holding member 2001.

Even with the pressurizing system, Expression (4) is not established when $h<0$. Therefore, the only restriction on the vertical direction required for the present embodiment does not narrow the range of restrictions compared to the pressurizing system.

Further, if the liquid holding member 2001 is liquid-tight, the leakage of the liquid can be suppressed even if the internal pressure of the liquid holding member 2001 is slightly higher than the atmospheric pressure P0, an external air pressure. The difference (withstanding pressure) between the external air pressure and the internal pressure of the liquid holding member 2001 that can suppress the leakage of the liquid is defined as $\Delta P$. In this case, a condition for preventing the leakage of the application liquid is:

$$Pin-\Delta P<P0 \tag{8}$$

Expression (7) is corrected as follows:

$$I<-(\rho\times g\times h+\Delta P)/Rin \tag{9}$$

To meet Expression (9), it is necessary to establish $\rho\times g\times h+\Delta P>0$, that is:

$$h<-\Delta P/(\Sigma\times g)$$

If the difference between the external air pressure and the internal pressure of the liquid holding member 2001 that can suppress the leakage of the liquid because of its liquid-tightness is $\Delta P$, the level in the storage tank 3003 may be higher than that in the liquid holding member 2001 provided that it is at most $\Delta P/(\rho\times g)$. In other words, it is not necessary for the present embodiment that the level in the storage tank 3003 is lower than that in the liquid holding member 2001.

Further, no pump is provided between the storage tank 3003 and the liquid supplying port 2004. Accordingly, it is possible to supply the liquid holding member 2001 with the amount of the application liquid of which is equal to the amount of the application liquid consumed in the liquid holding member 2001 without performing the control by which the amount of the consumption is supplied the liquid holding member 2001. It is thus unnecessary to perform the control of the amount of application liquid supplied taking into account the amount of application liquid consumed for applying, the control being required for the pressurizing system. This in turn makes it unnecessary to supply the application liquid at the maximum flow velocity Imax.

As described above, according to the present embodiment, the application liquid is circulated by providing the pump between the liquid collecting port in the liquid holding member and the storage tank. Consequently, the leakage of the application liquid from the liquid holding member can be suppressed simply by controlling the difference in water head between the liquid holding member and the level of the application liquid in the storage tank. Specifically, any positional relationship can be used provided that the liquid holding member is located above the level of application liquid in the direction of the gravity Further, the level of the application liquid in the storage tank may be located above the liquid holding member in the direction of the gravity as long as the height above the liquid holding member is within a predetermined range.

The leakage of the liquid from the liquid holding member can be suppressed without taking into account the fluid resistance in the liquid holding member and in the supply path from the storage tank to the liquid holding member. This eliminates the need to increase the cross section of and reduce the length of the liquid holding member or supply path. Therefore, the size of the applying apparatus can be reduced.

Further, the pump is placed on the liquid collecting port side of the liquid holding member. This eliminates the need to control the amount of application liquid supplied taking into account the amount of application liquid consumed for applying. This makes it unnecessary to provide a sensor or the like in order to control the level in the liquid holding member, the sensor or the like operating as level managing means for sensing the level in the liquid holding member. Therefore, the costs can be reduced.

Moreover, the application liquid from the storage tank is supplied to the liquid holding member in accordance with the consumption of the application liquid. Consequently, the value of a flow rate achieved by the pump may be smaller than the amount of application liquid consumed. Thus, the pressure need not be reduced more drastically than required.

Second Embodiment

According to the present embodiment, the pump is provided between the liquid collecting port in the liquid holding member and the storage tank. Further, if the driving of the pump is stopped with the level in the storage tank higher than the position of the liquid holding member by a predetermined or longer distance in the direction of the gravity, the liquid channel of the supply path is shut off.

In the present embodiment, for the configurations of the applying apparatus, liquid holding member, and liquid channel, parts similar to those in the first embodiment are denoted by the same reference numerals, and their description is omitted. Description will be given only of parts that are characteristic of the present embodiment.

In the first embodiment, the pump 3007 is provided in the collecting path in the liquid holding member 2001. This serves to accomplish circulation based on a decompression system. With this configuration, to prevent the leakage of the liquid from the liquid holding member 2001, the liquid holding member 2001 may have any height provided that it is higher than the level of the application liquid in the storage tank 3003. Further, the level in the storage tank 3003 may be higher than the liquid holding member 2001 provided that a predetermined condition is met. However, even if the level in the storage tank 3003 is higher than the liquid holding member 2001 by least a predetermined amount, the condition for preventing the leakage of the liquid is met by using the pump 3007 to set the velocity of flow of the application liquid at a predetermined or larger value as shown in Expression (7).

However, in connection with the consumption of power, it may be desirable that the pump 3007 not be driven; for example, the pump 3007 is desirably not driven when the applying apparatus is not used (for example, during a non-applying operation). In this case, since the pump 3007 is not driven, a flow of the application liquid cannot be generated. Consequently, the condition in Expression (7) cannot be met.

If the level in the storage tank 3003 is higher than the liquid holding member 2001 by at least the predetermined amount, the liquid may leak.

Thus, in FIG. 11, when the pump 3007 is not driven, the selector valve 3006 is switched from a connected state in which the tubes 3011 and 3012 are in communication (as shown in FIG. 22) to a connected state in which the tube 3012 and the air communicating port 3013 are in communication (as shown in FIG. 23). This shuts off the channel between the storage tank 3003 and the liquid holding member 2001. The shutoff of the channel makes it possible to eliminate the pressure caused by the difference in water head between the level in the storage tank 3003 and the liquid holding member 2001. The leakage of the liquid can thus be prevented. On the other hand, when the pump is driven, the leakage of the liquid is prevented by switching the selector valve 3006 to establish a channel between the tubes 3011 and 3012 to generate a predetermined flow velocity that meets Expression (7).

Figure 20:
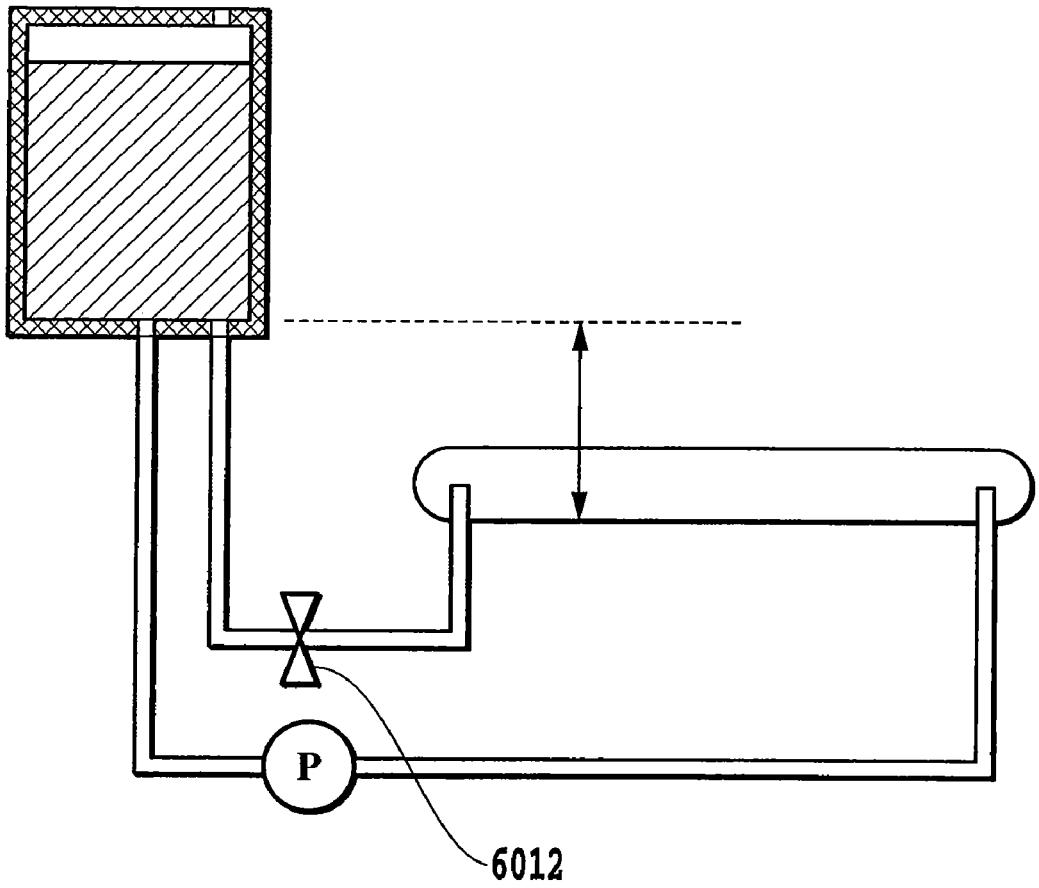
FIG. 20 is a diagram generally showing the configuration of the liquid channel in the liquid applying apparatus according to the embodiment of the present invention.
Figure 21:
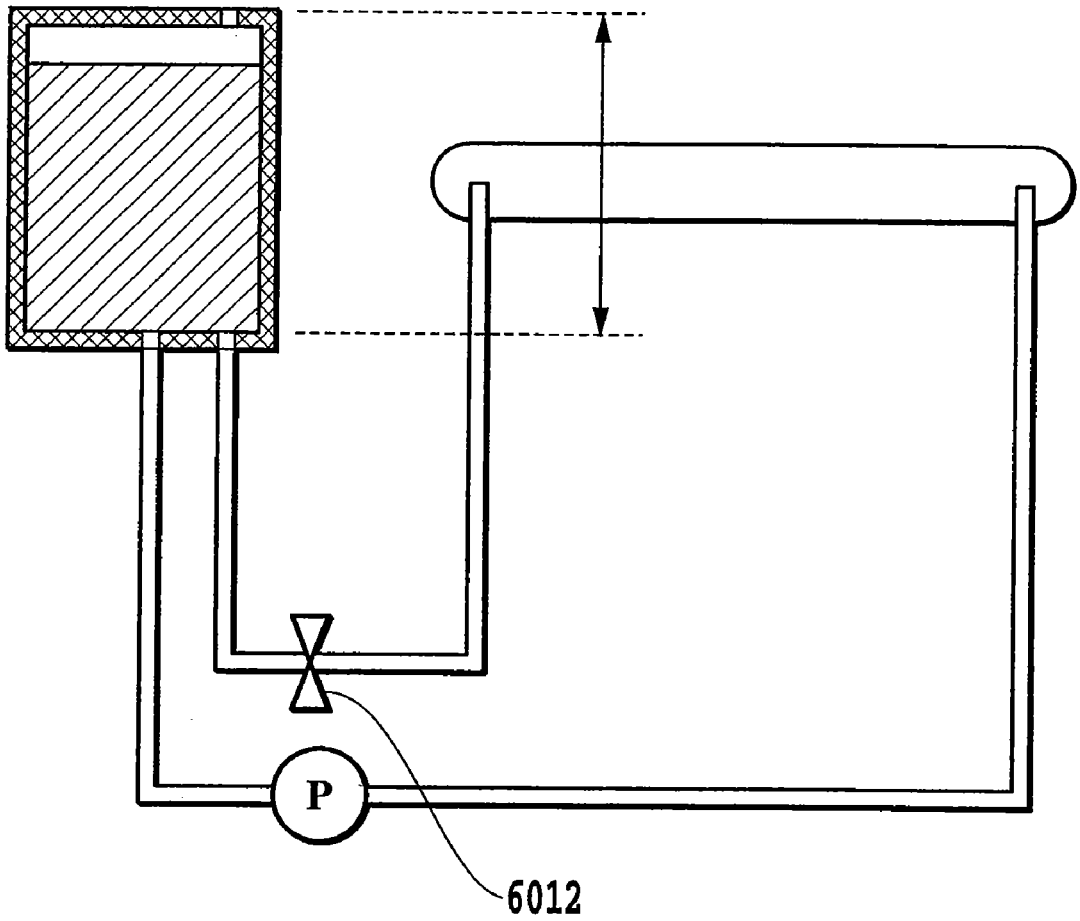
FIG. 21 is a diagram generally showing the configuration of the liquid channel in the liquid applying apparatus according to the embodiment of the present invention.

Further, in the present embodiment, as shown in FIGS. 20 and 21, the level in the storage tank 3003 is located above the liquid holding member 2001 in the direction of the gravity. A valve 6012 is provided in the supply path.

When the pump 3007 is not driven, the valve 6012 is closed to shut off the channel between the storage tank 3003 and the liquid holding member 2001. This eliminates the pressure caused by the difference in water head between the level in the storage tank 3003 and the liquid holding member 2001. The leakage of the liquid can thus be prevented. On the other hand, when the pump is driven, the leakage of the liquid is prevented by opening the valve 6012 to generate a predetermined flow velocity that meets Expression (7).

Further, the pump 3007 used in the present embodiment has a function for shutting off the channel when the pump 3007 is not driven. However, if the pump does not have the shutoff function, a valve having a function similar to that of the valve 6012 is placed on the collecting path. Even with the valve in this configuration, the valve function of the pump 3007 can be provided by opening the valve when the pump means is driven, while closing the valve when the pump means is not driven, as in the case with the valve 6012. In this case, the valve may be located closer to the storage tank 3003 side or the liquid holding member 2001 side with respect to the pump.

Moreover, in the present embodiment, the valve mechanism such as the selector valve 3006 or the valve 6012 the supply path is provided with are placed on the supply path to shut off the liquid channel. However, the present invention is not limited to this. Any form may be used provided that the channel between the storage tank 3003 and the liquid holding member 2001 is shut off when the driving of the pump is stopped. For example, it is possible to cap the supply port of the storage tank or liquid holding member.

As described above, according to the present embodiment, the level in the storage tank is higher than liquid holding member by at least the predetermined amount. Further, even if the driving of the pump is stopped, the selector valve or valve provided in the supply path is used to shut off the liquid supply path from the storage tank to the liquid holding member. This eliminates the pressure caused by the difference in water head between the level in the storage tank and the liquid holding member. It is thus possible to prevent the leakage of the liquid from the liquid holding member.

Another Embodiment

The first and second embodiments focus on the suppression of an increase in the internal pressure of the applying mechanism above the atmospheric pressure P0 for preventing the leakage of the liquid from the liquid holding member 2001. That is, the internal pressure of the liquid holding member 2001 maybe arbitrarily reduced below the atmospheric pressure P0.

However, when the internal pressure of the liquid holding member 2001 is too low, the air is likely to enter the liquid holding member 2001. If the air flows through the nip portion between the applying roller 1001 and the lower edge 2011, that is, the part of the liquid holding member 2001 through which the application liquid applied to the applying roller slipperily flows out, then the applying may become defective. Further, if an excessive amount of air flows in, the supply of the application liquid is hindered to make the applying defective.

If the liquid holding member 2001 is liquid-tight and its internal pressure is lower than the atmospheric pressure P0, an external air pressure, the maximum pressure difference (withstanding pressure) with which the air is prevented from flowing into the liquid holding member 2001 is defined as ΔP2.

If the mixture of air is considered, the lower pressure is taken into account. Accordingly, the pressure Pout at the collecting port is a severer condition than that Pin at the supply port. A condition for preventing the mixture of air is expressed by:

$$P0-Pout \leqq \Delta P2 \tag{10}$$

Thus, Expression (5) is substituted into Expression (10).

$$\rho \times g \times h+(Rin+R) \times I \leqq \Delta P2 \tag{11}$$

In Expression (11), the first item ρ×g×h in the left side denotes the pressure resulting from the water head difference h. When only the mixture of air is considered, the water head difference h is preferably as small as possible and more preferably negative, if possible, as indicated by Expression (11). However, the condition is reversed if the leakage of the liquid is considered as previously described. Further, the level in the storage tank 3003 varies as the application liquid is consumed by being supplied to the liquid holding member 2001. With this taken into account, if ΔP is comparable to ΔP2, the liquid holding member is desirably located between the level observed when the storage tank is full of the application liquid and the level observed when the application liquid has been used up, as shown in FIG. 21.

Furthermore, the second term (Rin+R)×I in the left side of Expression (11) indicates that to prevent the mixture of air, it is effective to set both the flow resistance Rin in the supply path and the flow resistance R in the liquid holding member at small values.

Three means are available for reducing the flow resistance Rin in the supply path.

First means is to increase the cross section of the supply path.

Second means is to minimize the length of the supply path. In this case, the liquid holding member 2001 is elongate in the horizontal direction. Therefore, depending on the longitudinal side of the liquid holding member 2001 on which the storage tank 3003 is placed, the distance between the liquid holding member 2001 and the storage tank 3003 varies between the liquid supplying port side and the liquid collecting port side. Thus, as shown in FIGS. 11, 20, and 21, the liquid supplying port is formed on the side on which the distance between the liquid holding member 2001 and the storage tank 303 is shorter. The liquid collecting port is formed on the other side. This makes it possible to reduce the length of the supply path.

Third means for reducing the flow resistance Rin in the supply path is to increase the number of supply paths. However, a simple increase in the number of supply paths may increase financial losses. It is thus more effective to increase the cross section as described above.

Another means for reducing the flow resistance R in the liquid holding member 2001 is to reduce the length of or increase the cross section of the liquid holding member 2001. However, the length of the liquid holding member is substantially determined by the width of the applied area of the applying medium. Therefore, as means for reducing the flow resistance R, it is more effective to increase the cross section of the liquid holding member 2001.

Further Another Embodiment

Figure 14:
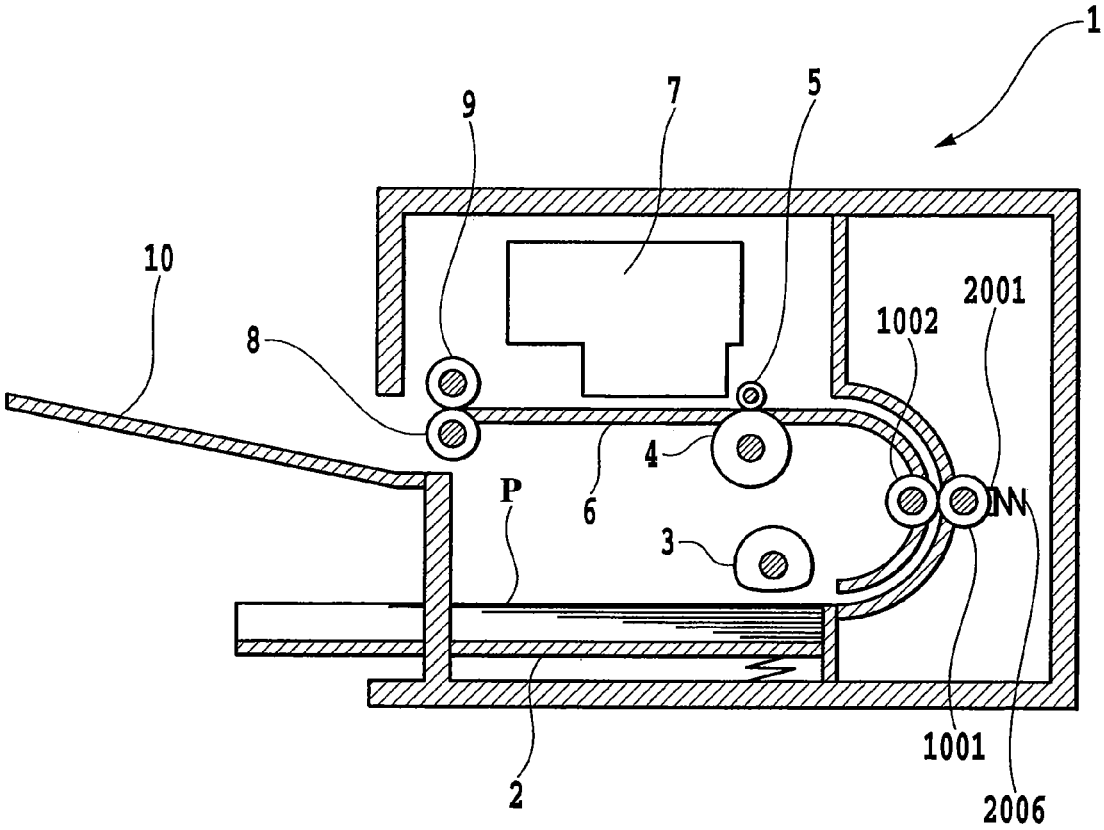
FIG. 14 is a vertical side view generally showing the configuration of an ink jet printing apparatus according to the embodiment of the present invention.

FIG. 14 is a diagram generally showing the configuration of an ink jet printing apparatus 1 comprising a applying mechanism having almost the same configuration as that of the above liquid applying apparatus.

The ink jet printing apparatus 1 is provided with a feeding tray 2 on which a plurality of print media P are stacked. A semicircular separating roller 3 separates each print medium P from the others stacked on the feeding tray and then feeds it to a conveying path. The applying roller 1001 and the counter roller 1002 are arranged in the conveying path; the applying roller 1001 and the counter roller 1002 constitute liquid applying means of the liquid applying mechanism. The print medium P fed by the feeding tray 2 is then fed to between the rollers 1001 and 1002. The applying roller 1001 is rotated clockwise in FIG. 14 by the rotation of a roller driving motor. The applying roller 1001 applies the application liquid to a print surface of the print medium P while conveying the print medium P. The print medium P to which the application liquid has been applied is fed to between a conveying roller 4 and a pinch roller 5. Then, the conveying roller 4 is rotated counterclockwise in the figure to convey the print medium P on a platen 6. The print medium P then moves to a position opposite to a print head 7 constituting printing means. The print head 7 is of an ink jet type in which a predetermined number of nozzles for ink ejection are disposed. While the print head 7 is being scanned in a direction perpendicular to the sheet of the drawing, printing is carried out by ejecting ink droplets from the nozzles to the print surface of the print medium P in accordance with print data. An image is formed on the print medium by alternately repeating a printing operation and a conveying operation performed by the conveying roller 4 to convey the print medium by a predetermined amount. Simultaneously with this image forming operation, the print medium P is sandwiched between a sheet discharging roller 8 and a sheet discharging spur 9 both provided downstream of the scan area of the print head in the conveying path for the print medium. The print medium P is then discharged onto a sheet discharging tray 10 by the rotation of the sheet discharging roller 8.

As this ink jet printing apparatus, what is called a full line type can be constructed in which an elongate print head having nozzles from which inks are ejected and which are disposed over the maximum width of the print medium is used to perform a printing operation.

The application liquid used in the present embodiment is a treatment liquid that facilitates the coagulation of pigments when inks composed of the pigments as color materials are used for printing.

In the present embodiment, the treatment liquid is used as a application liquid to react with the pigments, which are the color materials of the inks ejected to the print medium to which the treatment liquid has been applied. This facilitates the coagulation of the pigments. The facilitation of the coagulation of the pigments improves the printing density. Moreover, it is possible to suppress or prevent bleeding. The application liquid used in the ink jet printing apparatus is not limited to the above example.

Figure 15:
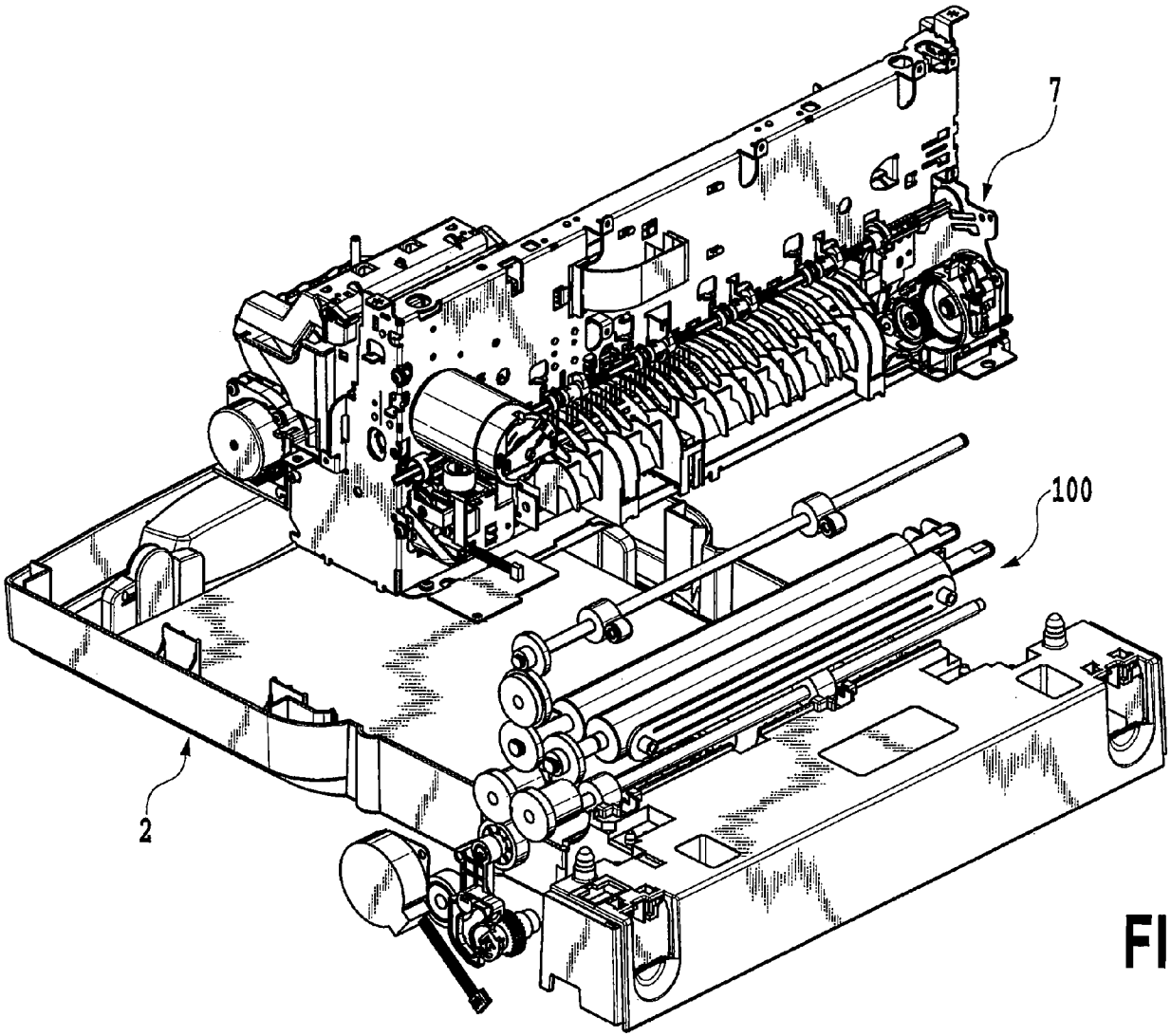
FIG. 15 is a perspective view showing how a printing section and the liquid applying apparatus are arranged if the ink jet printing apparatus according to the embodiment in FIG. 14 is configured as a serial printer type.

FIG. 15 is a perspective view showing an essential part of the above ink jet printing apparatus. As shown in the figure, a applying mechanism 100 is provided above one end of the feeding tray 2. A printing mechanism comprising the print head 7 and the like is provided above the applying mechanism 100 and above a central portion of the feeding tray 2.

Figure 16:
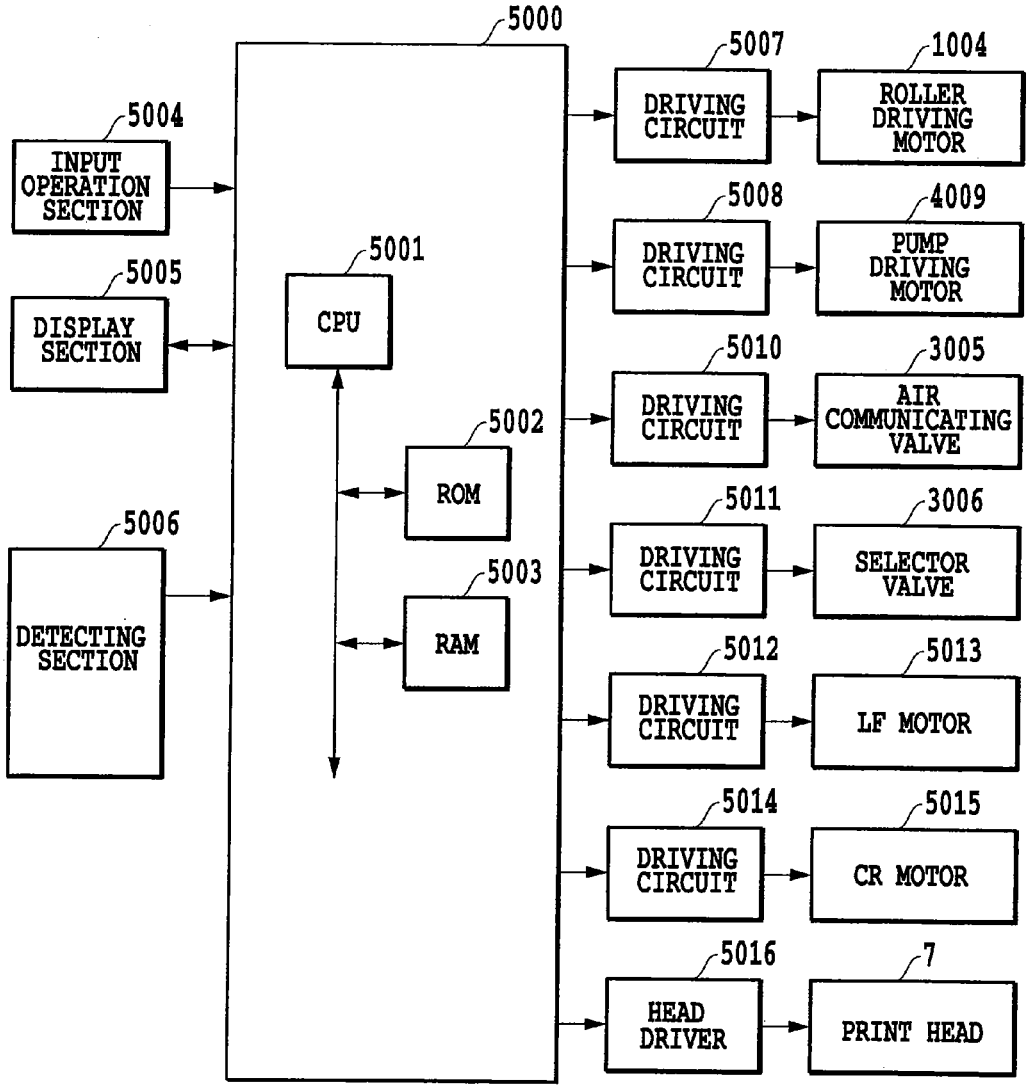
FIG. 16 is a block diagram generally showing the configuration of a control system of the ink jet printing apparatus according to the present invention.

FIG. 16 is a block diagram showing a control arrangement for the above ink jet printing apparatus. In this figure, the roller driving motor 1004, the pump driving motor 4009, and the actuator 3005 for the air communicating valve, all of which are elements of the liquid applying mechanism, are similar to those descried for the liquid applying apparatus.

In accordance with a program of a process procedure described later in FIG. 17, a CPU 5001 controls the driving of the elements of the applying mechanism. The CPU 5001 also controls the driving of an LF motor 5013, a CR motor 5015, and the print head 7 which relate to the printing mechanism, via driving circuits 5012 and 5014 and a head driver 5016. That Ls, driving by the LF motor 5013 rotates the conveying roller 4. Driving by the CR motor moves a carriage on which the print head 7 is mounted. Moreover, the CPU 5001 performs control such that inks are ejected through the nozzles in the print head.

Figure 17:
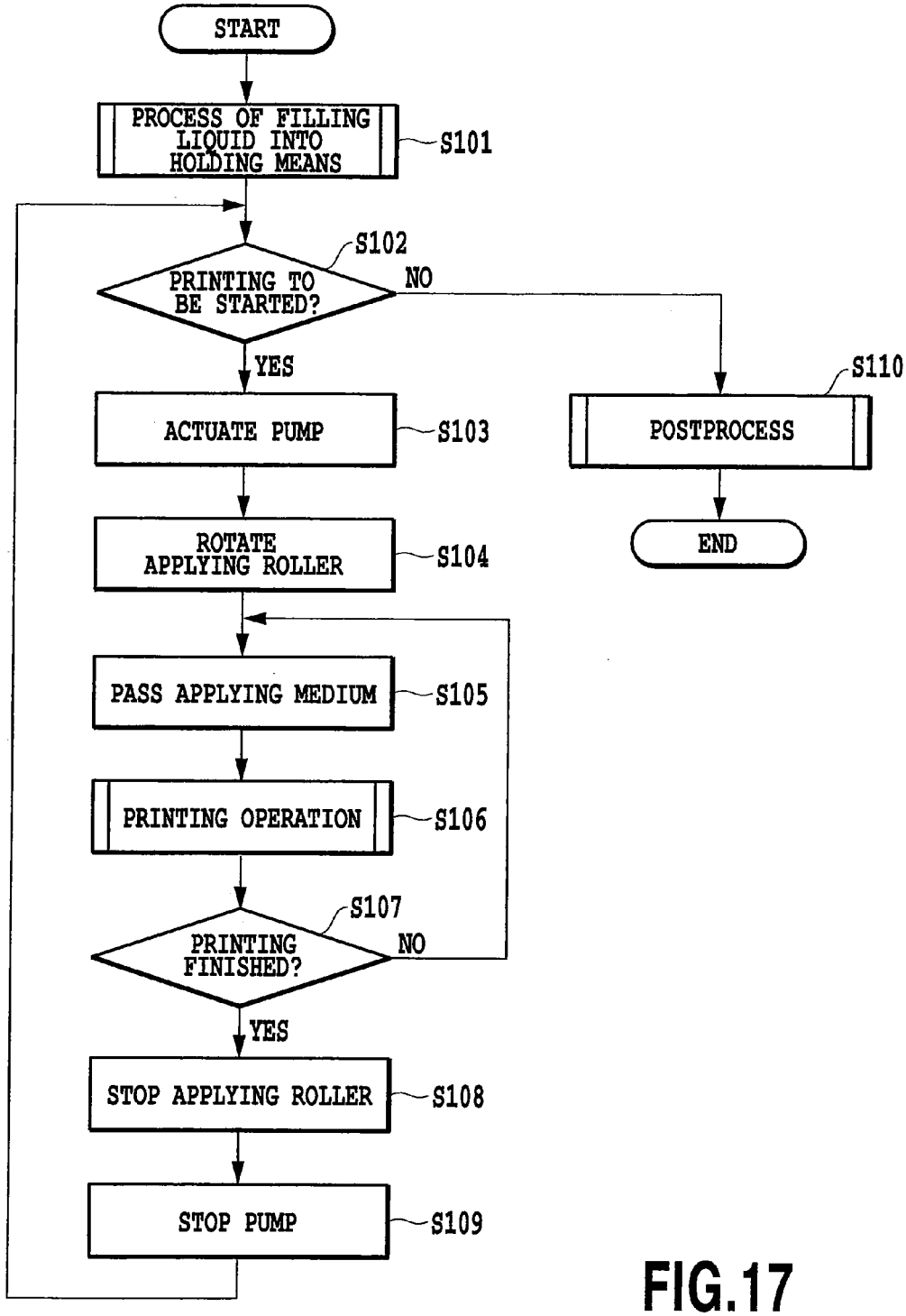
FIG. 17 is a flowchart showing the sequences of an applying operation and a printing operation according to another embodiment of the present invention.

FIG. 17 is a flowchart showing the procedure of liquid application and an accompanying printing operation in the ink jet printing apparatus according to the present embodiment. In the figure, the processing during steps S101, during S103 to S105, and during S108 to S110 is similar to that during step S1, during steps S3 to S5, and during steps S7 to S9, all the steps being shown in FIG. 13.

As shown in FIG. 17, in the present embodiment, a print start instruction is given (step S102). Then, a series of liquid applying operations such as pump activation are performed (steps S103 to S105). After this applying step, a printing operation is performed on a print medium having the application liquid applied to desired parts of the medium (step S106). That is, the print head 7 is scanned over the print medium P conveyed by the conveying roller 4 by a predetermined amount at a time. During the scan, inks are ejected from the nozzles in accordance with print data so as to adhere to the print medium to form dots. The adhering inks react with the application liquid, thus improving the concentration and preventing bleeding. The conveyance of the print medium and the scanning of the print head are repeated to print the print medium P. The finished print medium is discharged onto the sheet discharging tray 10.

In the present embodiment, as the liquid is applied to the print medium, printing is sequentially executed on parts of the print medium to which the liquid has already been applied. That is, the conveying path from the conveying roller to the print head is shorter than the print medium, and when a part of the print medium to which the liquid has already been applied reaches the scan area of the print head, the applying mechanism applies the liquid to another part of the print medium. Every time the print medium is conveyed by a predetermined amount, liquid application and printing are sequentially executed on different parts of the print medium. However, in an alternative form of application of the present invention, printing may be carried out after one print medium has been completely applied the application liquid to as described in Japanese Patent Application Laid-open No. 2002-096452.

When the apparatus determines in step S107 that the printing has been finished, the processing in step S108 and the subsequent steps is executed to finish the present process.

In the above embodiments, by way of example, the liquid is applied in the ink jet printing-based printing apparatus. However, the present invention is applicable to printing apparatuses based on other systems. For example, the degree of whiteness of the medium can be improved by using a liquid containing a fluorescent whitening agent as a application liquid, A liquid containing components to restrain a curl (phenomenon in which a medium becomes curve shape) of the application medium may be used. The printing means after the liquid application is not limited to the ink jet printing system. Effects can be produced using a printing system such as a thermal transfer system or an electrophotographic system. In a silver salt-based printing apparatus, a photosensitive agent as the application liquid may be applied before printing.

The present invention has been described in detail with respect to the preferred embodiments, and it will now be apparent from the foregoing to those skilled in the art that changes and modifications maybe made without departing from the invention in its broader aspects, and it is the intention, therefore, that the appended claims cover all such changes and modifications as fall within the true spirit of the invention.

This application claims priority from Japanese Patent Application No. 2004-035804 filed Feb. 12, 2004, which is hereby incorporated by reference herein.

What is claimed is:

1. An ink jet printing apparatus comprising:

a liquid applying unit comprising an applying member that applies to a medium a liquid which can react with an ink, a holding member, which includes an abutting member that continuously abuts against the applying member to form a liquid holding space to hold the liquid, and a biasing member which biases the abutting member against the applying member, the liquid applying unit applies the liquid held in the liquid holding space to the medium by rotating the applying member;

a printing unit that performs a printing operation for printing an image by ejecting the ink onto the medium to which the liquid has been applied by the liquid applying unit;

a storage unit that stores the liquid;

a first path for connecting the holding member and the storage unit to supply the liquid to the liquid holding space from the storage unit;

a second path for connecting the holding member and the storage unit to return the liquid from the liquid holding space to the storage unit; and a liquid moving unit, located in the second path, to generate a flow of the liquid in the first path, the liquid holding space, and the second path.

2. The ink jet printing apparatus according to claim 1, wherein the liquid moving unit generates the flow of the liquid so that a pressure at a second port formed in the holding member to connect the holding member and the second path is lower than a pressure at a first port formed in the holding member to connect the holding member and the first path.

3. The ink jet printing apparatus according to claim 1, wherein the holding member is located above the storage unit in a direction of gravity.

4. The ink jet printing apparatus according to claim 1, wherein the holding member is placed between a liquid level observed when an amount of the liquid stored in the storage unit is at a maximum amount and a level at a bottom of the storage unit.

5. The ink jet printing apparatus according to claim 2, wherein the first port is formed at a neighborhood of one end in a longitudinal direction of the holding member and the second port is formed at a neighborhood of another end in the longitudinal direction of the holding member.

6. The ink jet printing apparatus according to claim 2, wherein the storage unit is placed closer to the first port than to the second port.

7. The ink jet printing apparatus according to claim 1, wherein the first path is shorter than the second path.

8. The ink jet printing apparatus according to claim 1, further comprising a valve that shuts off a supply of the liquid to the liquid holding space through the first path, the valve being located in the first path.

9. The ink jet printing apparatus according to claim 8, wherein if driving of the liquid moving unit is stopped, the valve is used for shutoff.

10. The ink jet printing apparatus according to claim 1, wherein the liquid moving unit is driven to circulate the liquid through a circulation channel including the storage unit, the first path, the liquid holding space, and the second path.

11. The ink jet printing apparatus according to claim 10, wherein while the printing operation is performed, the liquid moving unit is driven to circulate the liquid through the circulation channel.

12. The ink jet printing apparatus according to claim 10, wherein after the printing operation is completed, a circulation operation of the liquid through the circulation channel by the liquid moving unit is performed.

13. The ink jet printing apparatus according to claim 1, wherein the liquid holding space is substantially closed.

14. The ink jet printing apparatus according to claim 1, wherein the liquid is returned from the liquid holding space to the storage unit by allowing the liquid holding space to communicate with atmosphere and using the liquid moving unit to generate the flow of the liquid.

15. An ink jet printing apparatus comprising:

a liquid applying unit that comprises an applying roller that applies to a medium a liquid for insolubilizing or coagulating a color material in an ink, a holding member, which includes an abutting member that continuously abuts against the applying roller to form a liquid holding space to hold the liquid, and a biasing member which biases the abutting member against the applying roller, the liquid applying unit applies the liquid held in the liquid holding space to the medium by rotating the applying roller;

a printing unit that performs a printing operation for printing an image by ejecting the ink onto the medium to which the liquid has been applied by the liquid applying unit;

a liquid storing tank;

a first path for supplying the liquid to the liquid holding space from the liquid storing tank;

a second path for returning the liquid from the liquid holding space to the liquid storing tank; and a pump, located in the second path, to generate a flow of the liquid in the first path, the liquid holding space, and the second path.

16. An ink jet printing apparatus comprising:

a liquid applying unit comprising an applying member that applies to a medium a liquid, a holding member, which includes an abutting member that continuously abuts against the applying member to form a liquid holding space to hold the liquid, and a biasing member which biases the abutting member against the applying member, the liquid applying unit applies the liquid held in the liquid holding space to the medium by rotating the applying member;

a printing unit that performs a printing operation for printing an image onto the medium to which the liquid has been applied by the liquid applying unit;

a storage unit that stores the liquid;

a first path for supplying the liquid to the liquid holding space from the storage unit;

a second path for returning the liquid from the liquid holding space to the storage unit; and a liquid moving unit, located in the second path, to generate a flow of the liquid in the first path, the liquid holding space, and the second path.

* * * * *